US008282369B2

(12) United States Patent
Yamamuro et al.

(10) Patent No.: US 8,282,369 B2
(45) Date of Patent: Oct. 9, 2012

(54) VARIABLE DISPLACEMENT VANE PUMP WITH DEFINED CAM PROFILE

(75) Inventors: Shigeaki Yamamuro, Zushi (JP); Fusao Semba, Saitama (JP)

(73) Assignee: Hitachi, Ltd., Tokyo (JP)

( * ) Notice: Subject to any disclaimer, the term of this patent is extended or adjusted under 35 U.S.C. 154(b) by 846 days.

(21) Appl. No.: 12/273,814

(22) Filed: Nov. 19, 2008

(65) Prior Publication Data

US 2009/0129960 A1 May 21, 2009

(30) Foreign Application Priority Data

Nov. 21, 2007 (JP) ..... 2007-301142

(51) Int. Cl.
*F01C 20/18* (2006.01)
*F04C 14/18* (2006.01)
*F04C 28/18* (2006.01)

(52) U.S. Cl. ..... 418/30; 418/31

(58) Field of Classification Search ..... 418/24–27, 418/30, 31
See application file for complete search history.

(56) References Cited

U.S. PATENT DOCUMENTS 6,503,068 B2 1/2003 Kojima et al.
2007/0212243 A1 * 9/2007 Yamamuro et al. ..... 418/30

FOREIGN PATENT DOCUMENTS

JP 2000-104672 A 4/2000
JP 2002-115673 A 4/2002
JP 2002168179 A * 6/2002

* cited by examiner

*Primary Examiner* — Mary A Davis
(74) *Attorney, Agent, or Firm* — Foley & Lardner LLP

(57) ABSTRACT

A variable displacement pump including a rotor, a plurality of vanes, a swingable cam ring, a suction port and a discharge port, wherein a dynamic radius of the vane which extends from a center of the rotor to a leading edge of the vane is gradually decreased in a closed section that is defined between a terminal end of the suction port and an initial end of the discharge port, along with rotation of the rotor, and a port timing defined as a position of the terminal end of the suction port or a position of the initial end of the discharge port with respect to a rotational position of the vane varies along with a swing motion of the cam ring.

7 Claims, 14 Drawing Sheets

VARIABLE DISPLACEMENT VANE PUMP WITH DEFINED CAM PROFILE

BACKGROUND OF THE INVENTION

The present invention relates to a variable displacement pump which serves as a hydraulic power source of a hydraulic device such as a power steering apparatus for vehicles.

Japanese Patent Application First Publication No. 2002-115673 discloses a variable displacement pump which is applied to a power steering apparatus for vehicles. The variable displacement pump of the conventional art includes an adapter ring fixed into a pump body, a driving shaft extending within the pump body, a cam ring swingably disposed on a fulcrum surface that is formed on an inner circumferential surface of the adapter ring, a rotor integrally formed with the driving shaft and rotatably disposed inside the cam ring, and a plurality of vanes disposed in slots that are formed on an outer periphery of the rotor in a radial direction of the rotor. The vanes are moveable to project from the slots and retreat into the slots in the radial direction of the rotor. A plurality of pump chambers are formed between the rotor, the vanes and the cam ring. Two side plates are disposed to be opposed to each other in an axial direction of the cam ring and the rotor and support the cam ring and the rotor therebetween. The pump body is formed with a suction port from which a working oil is sucked into the pump chambers and a discharge port from which the working oil in the pump chambers is discharged. First and second fluid pressure chambers are disposed between an inner circumferential surface of the adapter ring and an outer circumferential surface of the cam ring in a radially opposed relation to each other.

Further, the above-described conventional art discloses that a contour of an inner periphery of the cam ring is constituted of a shape of a suction section sucking a working fluid from the suction port, a shape of a first closed section at a bottom dead center transferring the working fluid sucked from the suction port to the discharge port after being previously compressed, a shape of a discharge section discharging the working fluid from the discharge port, and a shape of a second closed section transferring the working fluid held in the space between the adjacent vanes at a top dead center to the suction port. The portions of the inner periphery of the cam ring which corresponds to the suction section and the discharge section, respectively, are each shaped into a complete round curve and a transient curve. The portions of the inner periphery of the cam ring which corresponds to the respective closed sections are each shaped into a negative slope curve in which a radius of curvature reduces along the rotational direction of the rotor so as to always reduce a dynamic radius of the vane with respect to an increase of the rotational angle of the rotor despite the eccentric amount of the cam ring. The complete round curve and the negative slope curve are connected with each other through a high-order curve. The above-described conventional art aims to prevent a leading end of the vane from separating apart from an inner circumferential surface of the cam ring in the respective closed sections to thereby reduce a resultant pressure pulsation and generation of vibration and noise due to the pressure pulsation.

SUMMARY OF THE INVENTION

However, in the above-described conventional art, there is no discussion on variation in opening and closing timings of the suction port and the discharge port which will occur along with the swing motion of the cam ring. Therefore, an optimal design for taking measures against the vibration and noise is limited to a certain swing position of the cam ring where the leading end of the vane is prevented from separating apart from the inner circumferential surface of the cam ring. Thus, when the cam ring is located at the other swing positions, there might occur significant vibration and noise.

The present invention has been made in view of the above-described problems in the techniques of the conventional art. It is an object of the present invention to provide a variable displacement pump which can optimize opening and closing timings of a suction port and a discharge port regardless of a swing position of a cam ring.

In one aspect of the present invention, there is provided a variable displacement pump, comprising:

a pump body;

a driving shaft rotatably supported in the pump body;

a rotor that is disposed within the pump body and rotatably driven by the driving shaft, the rotor having a plurality of slots on an outer circumferential portion thereof, a plurality of vanes that are respectively fitted into the slots so as to project from the slots and retreat into the slots in a radial direction of the rotor, the plurality of vanes being rotatable together with the rotor in a rotational direction of the rotor, a cam ring that is disposed within the pump body so as to be swingable about a swing fulcrum, the cam ring cooperating with the rotor and the vanes to define a plurality of pump chambers on an inner circumferential side of the cam ring, a first member and a second member which are disposed on opposite sides of the cam ring in an axial direction of the cam ring, respectively;

a suction port and a discharge port which are disposed on a side of at least one of the first and second members, the suction port being opened to a suction region in which volumes of the plurality of pump chambers are increased along with rotation of the rotor, the discharge port being opened to a discharge region in which the volumes of the plurality of pump chambers are decreased along with rotation of the rotor, and a first fluid pressure chamber and a second fluid pressure chamber which are disposed on an outer circumferential side of the cam ring in an opposed relation to each other in a radial direction of the cam ring, the first fluid pressure chamber being disposed in one direction in which the cam ring is swingable to increase a discharge amount of a working fluid, the second fluid pressure chamber being disposed in the other direction in which the cam ring is swingable to reduce the discharge amount of a working fluid, wherein a dynamic radius of the vane which extends from a center of the rotor to a leading edge of each of the vanes is gradually decreased in a closed section that is defined between a terminal end of the suction port and an initial end of the discharge port, along with rotation of the rotor, and a port timing that is defined as a position of the terminal end of the suction port or a position of the initial end of the discharge port with respect to a rotational position of the vane varies along with a swing motion of the cam ring.

In a further aspect of the present invention, there is provided a variable displacement pump, comprising:

a pump body;

a driving shaft rotatably supported in the pump body;

a rotor that is disposed within the pump body and rotatably driven by the driving shaft, the rotor having a plurality of slots on an outer circumferential portion thereof, a plurality of vanes that are respectively fitted into the slots so as to project from the slots and retreat into the slots in a radial direction of the rotor, the plurality of vanes being rotatable together with the rotor in a rotational direction of the rotor, a cam ring that is disposed within the pump body so as to be swingable about a swing fulcrum, the cam ring cooperating with the rotor and the vanes to define a plurality of pump chambers on an inner circumferential side of the cam ring, a first member and a second member which are disposed on opposite sides of the cam ring in an axial direction of the cam ring, respectively;

a suction port and a discharge port which are disposed on a side of at least one of the first and second members, the suction port being opened to a suction region in which volumes of the plurality of pump chambers are increased along with rotation of the rotor, the discharge port being opened to a discharge region in which the volumes of the plurality of pump chambers are decreased along with rotation of the rotor, and a first fluid pressure chamber and a second fluid pressure chamber which are disposed on an outer circumferential side of the cam ring in an opposed relation to each other in a radial direction of the cam ring, the first fluid pressure chamber being disposed in one direction in which the cam ring is swingable to increase a discharge amount of a working fluid, the second fluid pressure chamber being disposed in the other direction in which the cam ring is swingable to reduce the discharge amount of a working fluid, wherein an inner circumferential surface of the cam ring defines a cam profile including a part of a circle curve substantially concentric with the rotor, the part of the circle curve extending over a closed section that is defined between a terminal end of the suction port and an initial end of the discharge port, the cam ring is disposed offset from the rotation center of the rotor toward a side of the suction port, and a port timing that is defined as a position of the terminal end of the suction port or a position of the initial end of the discharge port with respect to a rotational position of the vane varies along with a swing motion of the cam ring.

In a still further aspect of the present invention, there is provided a variable displacement pump, comprising:

a pump body;

a driving shaft rotatably supported in the pump body;

a rotor that is disposed within the pump body and rotatably driven by the driving shaft, the rotor having a plurality of slots on an outer circumferential portion thereof, a plurality of vanes that are respectively fitted into the slots so as to project from the slots and retreat into the slots in a radial direction of the rotor, the plurality of vanes being rotatable together with the rotor in a rotational direction of the rotor, a cam ring that is disposed within the pump body so as to be swingable about a fulcrum on a fulcrum surface that is disposed on an inner surface of the pump body, the cam ring cooperating with the rotor and the vanes to define a plurality of pump chambers on an inner circumferential side of the cam ring, a first member and a second member which are disposed on opposite sides of the cam ring in an axial direction of the cam ring, respectively;

a suction port and a discharge port which are disposed on a side of at least one of the first and second members, the suction port being opened to a suction region in which volumes of the plurality of pump chambers are increased along with rotation of the rotor, the discharge port being opened to a discharge region in which the volumes of the plurality of pump chambers are decreased along with rotation of the rotor, and a first fluid pressure chamber and a second fluid pressure chamber which are disposed on an outer circumferential side of the cam ring in an opposed relation to each other in a radial direction of the cam ring, the first fluid pressure chamber being disposed in one direction in which the cam ring is swingable to increase a discharge amount of a working fluid, the second fluid pressure chamber being disposed in the other direction in which the cam ring is swingable to reduce the discharge amount of a working fluid, wherein the fulcrum surface is formed such that a distance from a reference line that connects a rotation center of the driving shaft with a midpoint between a terminal end of the suction port and an initial end of the discharge port is gradually increased from the swing fulcrum toward a side of the second fluid pressure chamber, a dynamic radius of the vane which extends from a rotation center of the rotor to a leading edge of each of the vanes is gradually decreased in a closed section that is defined between the terminal end of the suction port and the initial end of the discharge port, along with rotation of the rotor, and a port timing that is defined as a position of the terminal end of the suction port or a position of the initial end of the discharge port with respect to a rotational position of the vane varies along with a swing motion of the cam ring.

The other objects and features of this invention will become understood from the following description with reference to the accompanying drawings.

DETAILED DESCRIPTION OF THE INVENTION

Figure 1:
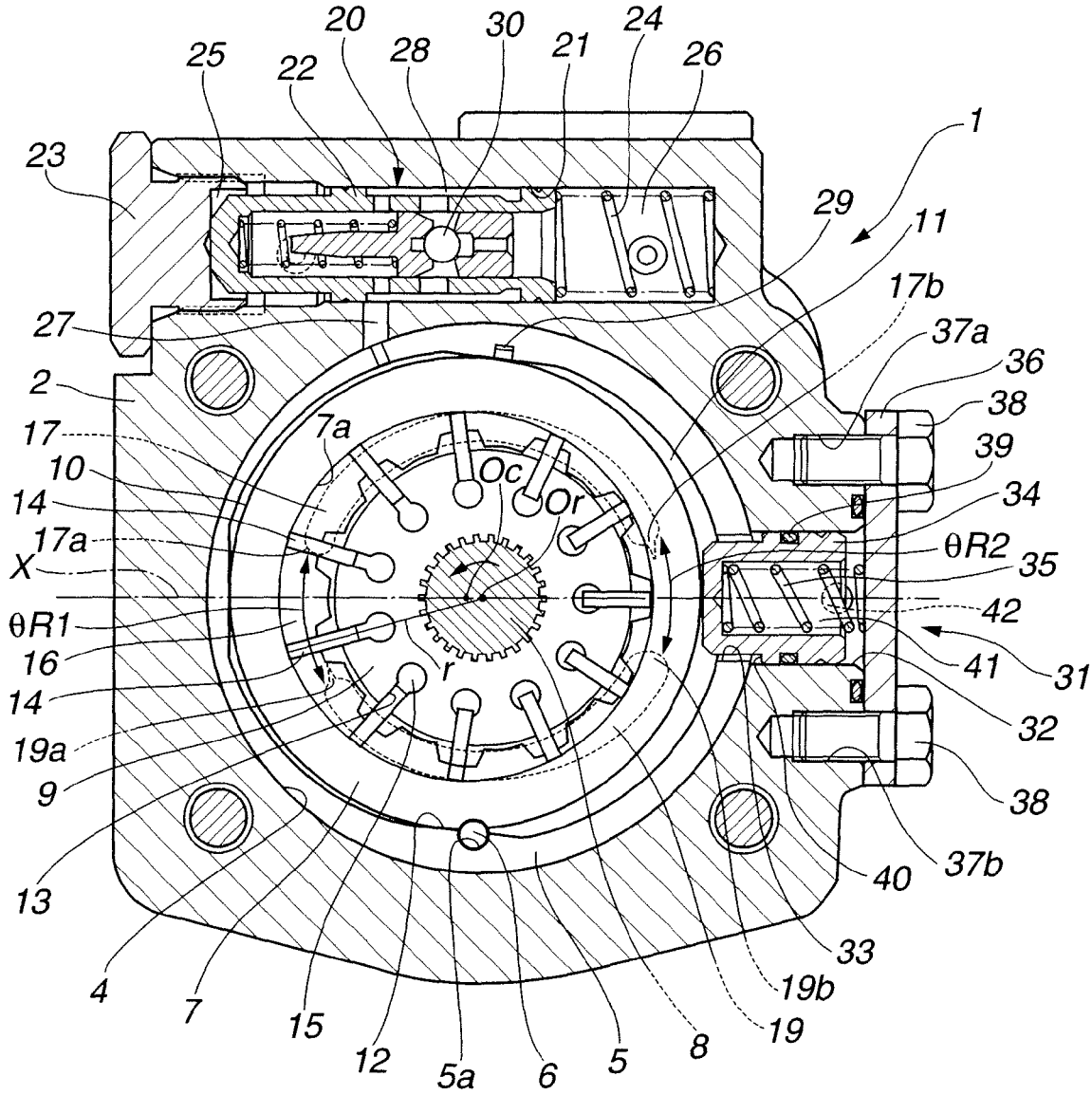
FIG. 1 is a cross-section of a variable displacement pump of a first embodiment according to the present invention, taken in a direction perpendicular to an axial direction of the variable displacement pump.
Figure 2:
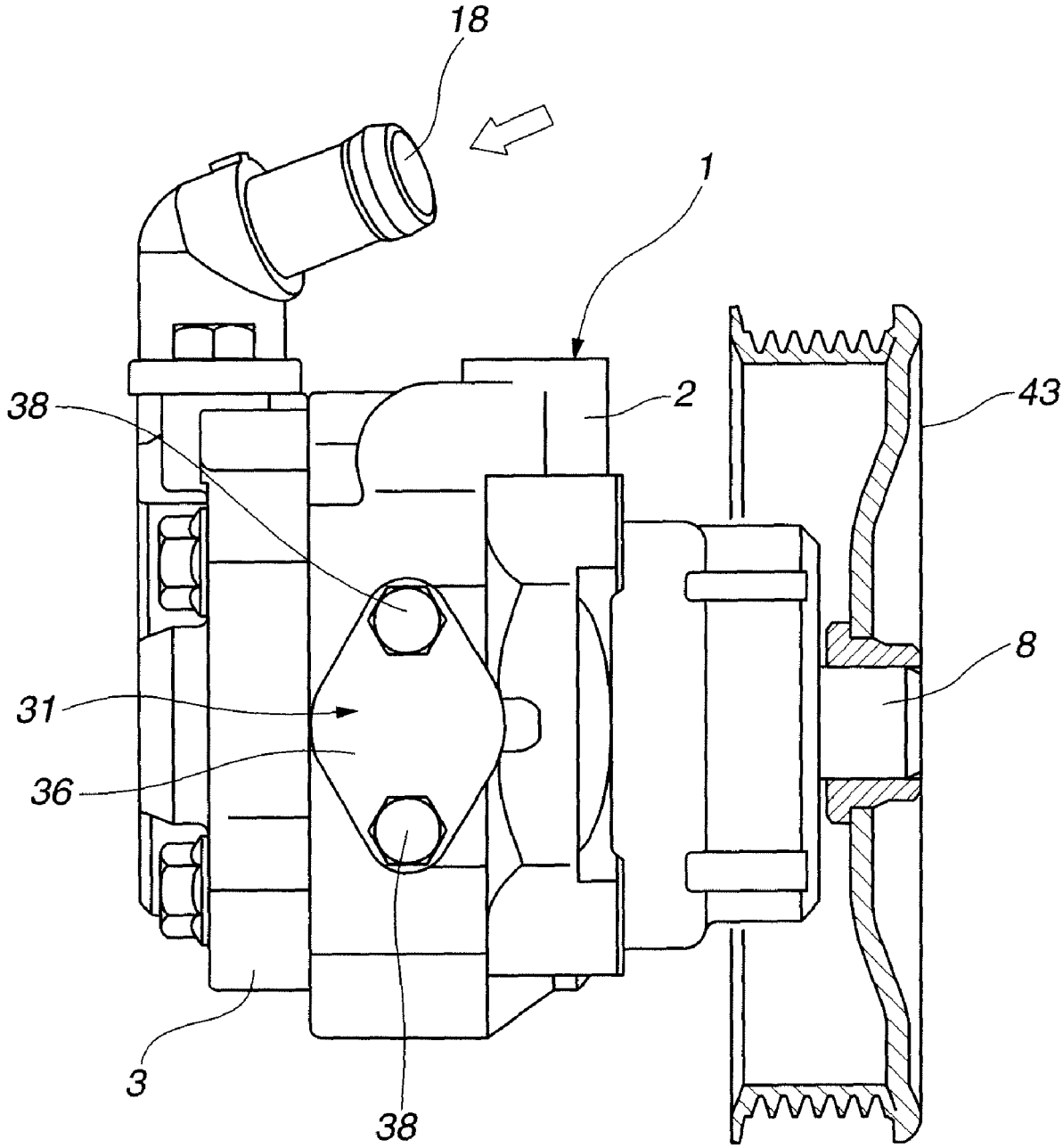
FIG. 2 is a side view of the variable displacement pump of the first embodiment, showing a part of the variable displacement pump in cross-section taken in the axial direction thereof.

Referring now to FIG. 1 through FIG. 10, a first embodiment of a variable displacement pump according to the present invention, is explained. In this embodiment, the variable displacement pump is applied to a power steering apparatus for vehicles. As shown in FIG. 1 and FIG. 2, the variable displacement pump includes pump housing 1, adapter ring 5 disposed within pump body 1, cam ring 7 disposed on an inside of adapter ring 5, driving shaft 8 that supported on pump housing 1 and rotatably disposed on an inner circumferential side of cam ring 7, and rotor 9 coaxially connected to driving shaft 8. Pump housing 1 includes front pump body 2 and rear cover 3 as a first member which are joined with each other in an axial direction of pump housing 1. Adapter ring 5 is fitted into installation space 4 for cam ring 7 and rotor 9 which is formed on an inside of pump housing 1. Cam ring 7 is disposed within a generally elliptic hole of adapter ring 5 and swingably moveable rightward and leftward as viewed in FIG. 1.

Adapter ring 5 serves as a part of pump body 2 and forms an inner circumferential surface of pump body 2. As shown in FIG. 1, adapter ring 5 includes pin holding groove 5*a* that has a semi-circular section and is formed on a lower portion of an inner circumferential surface of adapter ring 5. Pin holding groove 5*a* is engaged with position-retaining pin 6 that holds cam ring 7 in place by engagement with pin holding groove 5*a*. Adapter ring 5 further includes fulcrum surface 12 on which a swing fulcrum of a swing motion of cam ring 7 is located. Fulcrum surface 12 is disposed on a side of first fluid pressure chamber 10 relative to position-retaining pin 6 as explained later and has a predetermined area. Position-retaining pin 6 acts not as the swing fulcrum of a swing motion of cam ring 7 but as a detent that holds cam ring 7 and restrains cam ring 7 from rotating relative to adapter ring 5.

Figure 3:
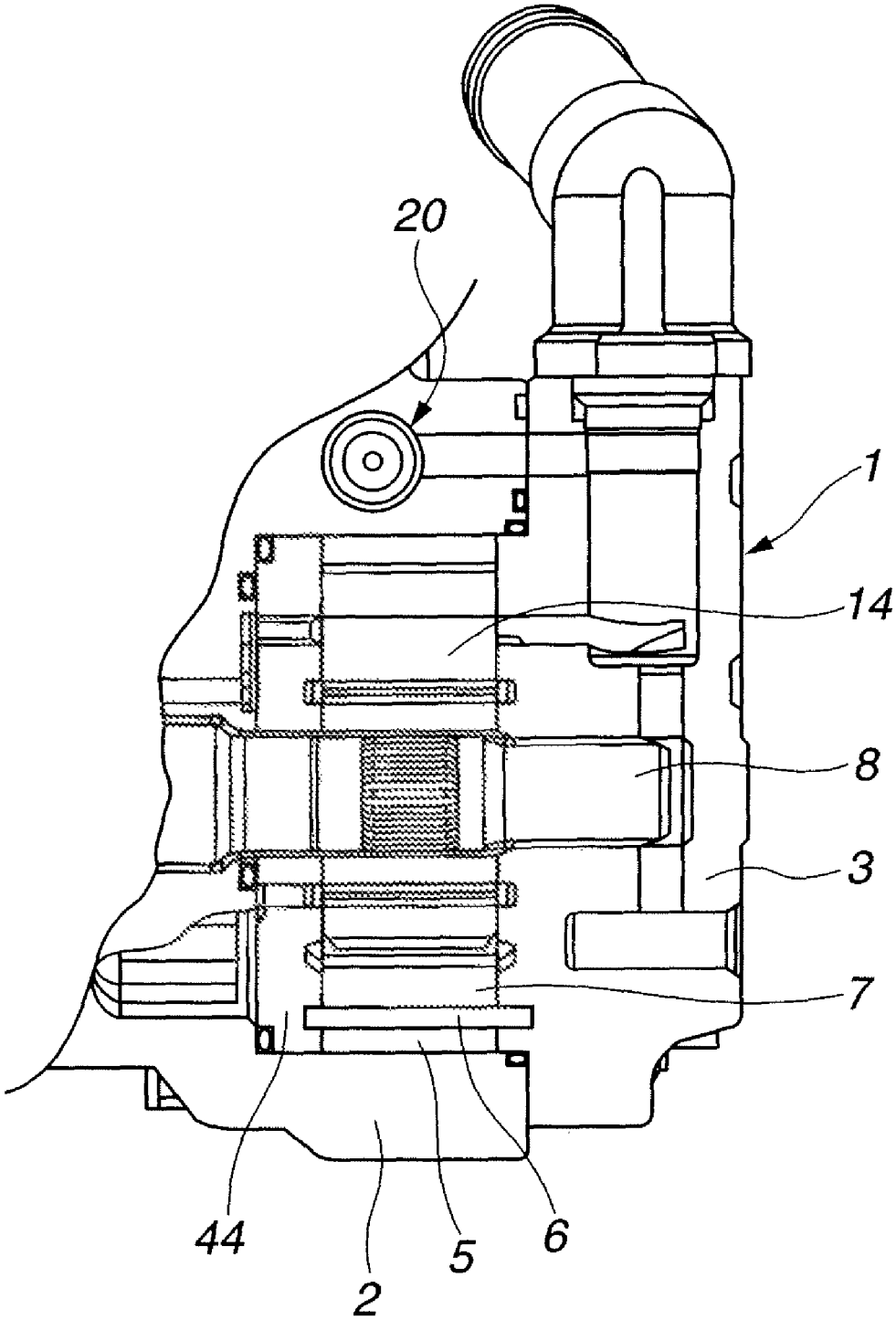
FIG. 3 is a schematic section of the variable displacement pump of the first embodiment, taken in the axial direction of the variable displacement pump.

Cam ring 7 is formed into a generally annular shape and disposed within installation space 4 so as to be moveable to an eccentric position relative to rotor 9. Cam ring 7 defines first fluid pressure chamber 10 and second fluid pressure chamber 11 in cooperation with adapter ring 5, position-retaining pin 6, and seal 29 that is disposed in a substantially diametrically opposed relation to position-retaining pin 6. That is, a space between an outer circumferential surface of cam ring 7 and an inner circumferential surface of adapter ring 5 is divided into first fluid pressure chamber 10 and second fluid pressure chamber 11 which are located in an opposed relation to each other in a radial direction of cam ring 7. First fluid pressure chamber 10 is disposed in one direction in which a discharge amount of a working fluid which is discharged from the discharge port is increased. Second fluid pressure chamber 11 is disposed in the other direction in which the discharge amount of a working fluid is reduced. Cam ring 7 is swingable or pivotable about the swing fulcrum that is located in a predetermined position on fulcrum surface 12 of adapter ring 5. Cam ring 7 is swingably moveable on fulcrum surface 12 toward a side of first fluid pressure chamber 10 and a side of second fluid pressure chamber 11. As shown in FIG. 3, cam ring 7 and rotor 9 are interposed between rear cover 3 and disk-shaped pressure plate 44 that is disposed on a side of a bottom of installation space 4 of pump housing 1.

Rotor 9 is driven by driving shaft 8 to make a unitary rotation with driving shaft 8 in a counterclockwise direction indicated by an arrow in FIG. 1. Driving shaft 8 is driven to be rotatable about a rotation axis by an engine crankshaft through driven pulley 23. A plurality of slots 13 are formed in an outer circumferential periphery of rotor 9 and circumferentially equidistantly spaced from each other. Each of slots 13 extends in both an axial direction of rotor 9 and a radial direction of rotor 9. Slot 13 is continuously connected with back pressure chamber 15 which is disposed at a radial-inner end of slot 13 and supplied with a working fluid. Vane 14 is disposed in each of slots 13 and movable in the radial direction of rotor 9 so as to project from and retreat into slot 13 depending on change in fluid pressure of the working fluid within back pressure chamber 15.

A plurality of pump chambers 16 are formed by adjacent two vanes 14 in a space that is formed between cam ring 7 and rotor 9. That is, each of pump chambers 16 is defined by cam ring 7, rotor 9 and the adjacent two vanes 14. Volumes of pump chambers 16 are variable by controlling the swing motion of cam ring 7 about the swing fulcrum on fulcrum surface 12.

Suction port 17 is disposed on a front end surface of rear cover 3 which is opposed to cam ring 7 and rotor 9. Suction port 17 is opened to a suction region where the volumes of pump chambers 16 are increased along with the rotation of rotor 9. Suction port 17 supplies respective pump chambers 16 with the working fluid that is sucked from a reservoir tank through suction passage 18. Suction port 17 has an arcuate shape in section as shown in FIG. 1.

Discharge port 19 and a discharge hole, not shown, that is communicated with discharge port 19 are disposed on an end surface of pressure plate 44 which is opposed to cam ring 7 and rotor 9. Discharge port 19 and the discharge hole are opened to a discharge region where the volumes of pump chambers 16 are decreased along with the rotation of rotor 9. The working fluid that is discharged from pump chambers 16 is introduced into a discharge-side pressure chamber, not shown, which is formed on a bottom surface of pump body 2, through discharge port 19 and the discharge hole. The working fluid is fed from a discharge passage, not shown, in pump housing 1 to a hydraulic power cylinder of the power steering apparatus via a piping.

Control valve 20 is arranged within pump body 2 and has an axis which extends in a direction perpendicular to the rotation axis of driving shaft 8. As shown in FIG. 1, control valve 20 includes spool valve 22 and valve spring 24. Spool valve 22 is slidably disposed in valve bore 21 having one closed end which is formed in pump body 2. Valve spring 24 biases spool valve 22 in a leftward direction in FIG. 1 so as to press against plug 23 that is fitted to the other open end of valve bore 21. High-pressure chamber 25 is disposed between plug 23 and a tip end of spool valve 22, into which a high fluid pressure on an upstream side of a metering orifice, not shown, is introduced. A fluid pressure on a downstream side of the metering orifice is supplied to spring chamber 26 in which valve spring 24 is accommodated. When a difference between the fluid pressure in spring chamber 26 and the fluid pressure in high-pressure chamber 25 reaches a predetermined value or more, spool valve 22 is urged to move in a rightward direction in FIG. 1 against a spring force of valve spring 24. Relief valve 30 is disposed in spool valve 22. Relief valve 30 is operative to open and drain the working fluid in spring chamber 26 when the fluid pressure in spring chamber 26 reaches a predetermined value or more, namely, when an operating pressure of the power steering apparatus becomes the predetermined value or more.

When spool valve 22 is placed on the left side in valve bore 21 in FIG. 1, first fluid pressure chamber 10 is communicated with pump suction chamber 28 within valve bore 21 through communication passage 27. A low fluid pressure is introduced from suction port 17 into pump suction chamber 28 through a suction hole, not shown, that is formed in pump body 2. When spool valve 22 is caused to move to the right side in valve bore 21 in FIG. 1 due to the difference between the fluid pressure in spring chamber 26 and the fluid pressure in high-pressure chamber 25, the fluid communication between first fluid pressure chamber 10 and pump suction chamber 28 is gradually blocked and fluid communication between first fluid pressure chamber 10 and high-pressure chamber 25 is established to introduce the working fluid with high pressure into first fluid pressure chamber 10. Control valve 20 thus selectively supplies the low fluid pressure in pump suction chamber 28 and the high fluid pressure on the upstream side of the metering orifice to first fluid pressure chamber 10.

In contrast, second fluid pressure chamber 11 is not directly connected with control valve 20 but is communicated with suction passage 18 through an introduction hole that is formed in pressure plate 44. The fluid pressure on the suction side, i.e., the low fluid pressure from suction passage 18, is always introduced into second fluid pressure chamber 11 through the introduction hole.

Fulcrum surface 12 on adapter ring 5 has a predetermined area that extends from the side of first fluid pressure chamber 10 to position retaining pin 6 in a circumferential direction of adapter ring 5. Fulcrum surface 12 is declined toward the side of second fluid pressure chamber 11 so as to be gradually apart from reference line X that passes through rotation center P of driving shaft 8, namely, rotation center Or of rotor 9, and a midpoint between terminal end 17*a* of suction port 17 and initial end 19*a* of discharge port 19. Specifically, fulcrum surface 12 is inclined such that a distance between fulcrum surface 12 and reference line X is gradually increased. Fulcrum surface 12 is defined as a reverse inclination and has an inclination angle of about a few degrees with respect to reference line X.

Figure 5A:
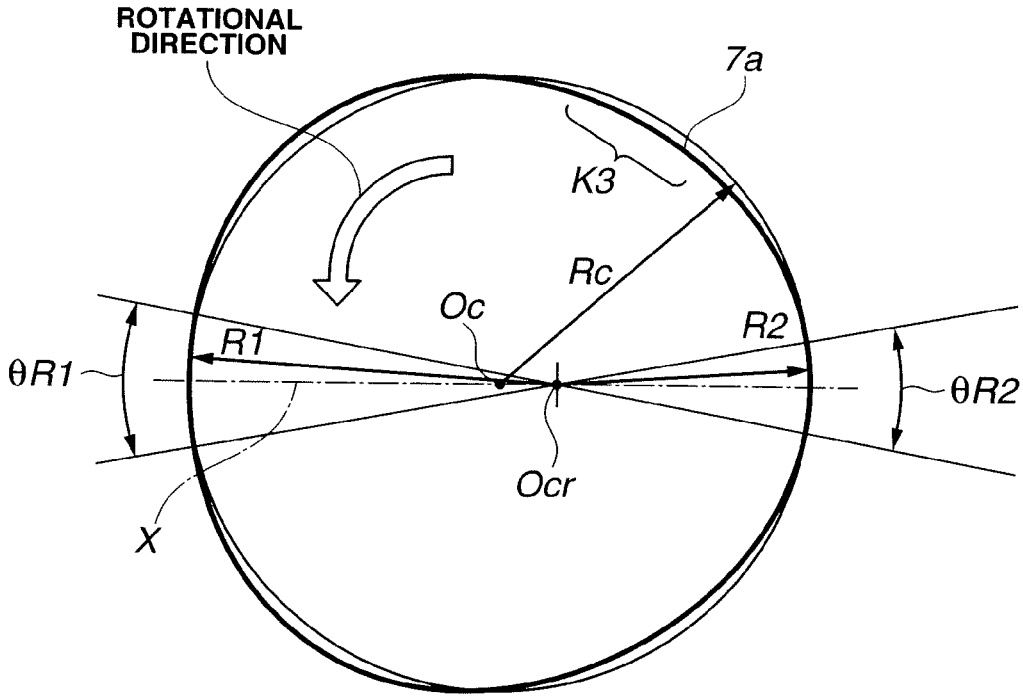
FIG. 5A and FIG. 5B are schematic diagrams each illustrating a cam profile of a cam ring in the variable displacement pump of the first embodiment when viewed from the axial direction of the variable displacement pump.

As shown in FIG. 5A, first closed section θR1 is located between terminal end 17*a* of suction port 17 and initial end 19*a* of discharge port 19, and second closed section θR2 is located between terminal end 19*b* of discharge port 19 and initial end 17*b* of suction port 17.

As shown in FIG. 1, cam ring biasing mechanism 31 is disposed on pump body 2 on the side of second fluid pressure chamber 11 in substantial alignment with reference line X. Cam ring biasing mechanism 31 acts to bias cam ring 7 toward the side of first fluid pressure chamber 10. Cam ring biasing mechanism 31 includes first slide hole 32 and second slide hole 33 which are continuously connected with each other along reference line X, plunger 34 that is slidably disposed in slide holes 32 and 33, and coil spring 35 that biases plunger 34 toward cam ring 7 by the spring force.

Specifically, first slide hole 32 is formed in a side wall of pump body 2 and extends from an outer surface of the side wall to installation space 4 through the side wall. First slide hole 32 is covered with lid 36 at an outer end thereof that is opened to the outer surface of the side wall of pump body 2. As shown in FIG. 1 and FIG. 2, flat rhombus-shaped lid 36 is fixed to pump body 2 at upper and lower end portions of lid 36 by two bolts 38, 38. Two bolts 38, 38 are screwed into bolt holes 37*a*, 37*b* that are formed in the side wall of pump body 2 so as to extend in parallel to reference line X on upper and lower sides of reference line X. Second slide hole 33 extends through a circumferential wall of adapter ring 5 in a radial direction of adapter ring 7. Second slide hole 33 is in axial alignment with first slide hole 32 and slightly smaller in inner diameter than first slide hole 32.

Plunger 34 is made of a material having the same coefficient of thermal expansion as that of a material of pump body 2. For instance, the material of plunger 34 is aluminum alloy. Plunger 34 has a hollow cylindrical shape with one closed end and includes a large-diameter cylindrical body portion that is slidably moveable in first slide hole 32, and a small-diameter cylindrical tip end portion that is slidably moveable in second slide hole 33. The body portion has an outer diameter slightly smaller than an inner diameter of first slide hole 32 to thereby ensure slidability thereof. Annular seal 39 is fixedly fitted into an annular groove that is formed on an outer circumferential surface of the body portion. Annular seal 39 seals pressure receiving chamber 41 that is disposed between an inner circumferential surface of first slide hole 32 and the outer circumferential surface of the body portion. On the other hand, the tip end portion of plunger 34 has an outer diameter slightly smaller than the outer diameter of the body portion, so that a step between the tip end portion and the body portion is formed. The step serves as engaging portion 40 that abuts on a radial-outer edge of second slide hole 33 and limits the sliding movement of plunger 34 in a radially inward direction of adapter ring 7 when plunger 34 is moved to project into the inside of adapter ring 7. The tip end portion of plunger 34 includes a flat disk-shaped end wall having an outer surface that is exposed to second fluid pressure chamber 11 through second slide hole 33 and in contact with the outer circumferential surface of cam ring 7.

Coil spring 35 is elastically contacted with an inner surface of the end wall of the tip end portion of plunger 34 and with an inside surface of lid 36. Coil spring 35 biases plunger 34 by a predetermined spring force in such a direction as to project from first and second slide holes 32 and 33. Thus, coil spring 35 always biases cam ring 7 toward first fluid pressure chamber 10 through plunger 34, that is, in a direction in which the volumes of pump chambers 16 are increased.

Plunger 34 is also urged by the discharge fluid pressure from discharge port 19 so as to bias cam ring 7 toward first fluid pressure chamber 10, in addition to the spring force of coil spring 35. Specifically, pressure receiving chamber 41 is defined between the inside surface of lid 36, the inner circumferential surface of first slide hole 32 and an inner circumferential surface of plunger 34. Pressure receiving chamber 41 is communicated with discharge port 19 through introduction passage 42 that is formed in pump body 2. Introduction passage 42 has one end that is opened to discharge port 19 and the other end that is opened to pressure receiving chamber 41. With this construction, the high fluid pressure discharged from discharge port 19 is introduced into pressure receiving chamber 41 and acts on the inner surface of the end wall of the tip end portion of plunger 34 to thereby urge plunger 34 toward cam ring 7.

Each of vanes 14 has dynamic radius r that extends from center Or of rotor 9 to a leading edge of vane 14 as shown in FIG. 1. Dynamic radius r is gradually decreased in first closed section θR1 that is defined between terminal end 17*a* of suction port 17 and initial end 19*a* of discharge port 19, along with the rotation of rotor 9. In other words, inner circumferential surface 7*a* of cam ring 7 defines a predetermined cam profile that includes a part of a circle curve substantially concentric with rotor 9. The part of the circle curve extends over first closed section θR1.

Specifically, inner circumferential surface 7*a* of cam ring 7 defines an oval cam profile as shown in FIG. 5A. In FIG. 5A, a thick line indicates the oval cam profile of cam ring 7 which has a center Oc, and a thin line indicates a complete round as a reference circle which is centered at center Oc and has radius Rc. The oval cam profile includes a first curve that extends over first closed section θR1 and a part of a non-closed section between first closed section θR1 and second closed section θR2, a second curve that extends over second closed section θR2 and a part of the non-closed section, and transition curve K3 that extends over a part of the non-closed section and connects the first curve and the second curve with each other. The first curve includes a part of a first circle that is centered at point Ocr and has radius R1. Point Ocr indicates a position of the center of rotor 9 from which center Oc of the oval cam profile of cam ring 7 is horizontally offset by a predetermined eccentric amount toward a side of first closed section θR1. The second curve includes a part of a second circle that is centered at point Ocr similar to the first curve and has radius R2.

The first circle crosses the reference circle of the complete round which is centered at Oc and has radius Rc, in first closed section θR1. The second circle crosses the reference circle of the complete round which is centered at Oc and has radius Rc, in second closed section θR2. The first curve and the second curve of the oval cam profile are smoothly connected with each other through transition curve K3 in the non-closed section. There is no change in curvature at the connection between the first curve and transition curve K3 and at the connection between the second curve and transition curve K3. Transition curve K3 has substantially the same radius of curvature as radius Rc of the reference circle of the complete round in the vicinity of top and bottom positions in the oval cam profile in a vertical direction extending from center Oc of cam ring 7 as shown in FIG. 5A. The oval cam profile has a large radius of curvature on a side of first closed section θR1 and a small radius of curvature on a side of second closed section θR2.

Cam ring 7 having the oval cam profile as explained above is assembled to adapter ring 5 that has fulcrum surface 12 with the reverse inclination.

Figure 4:
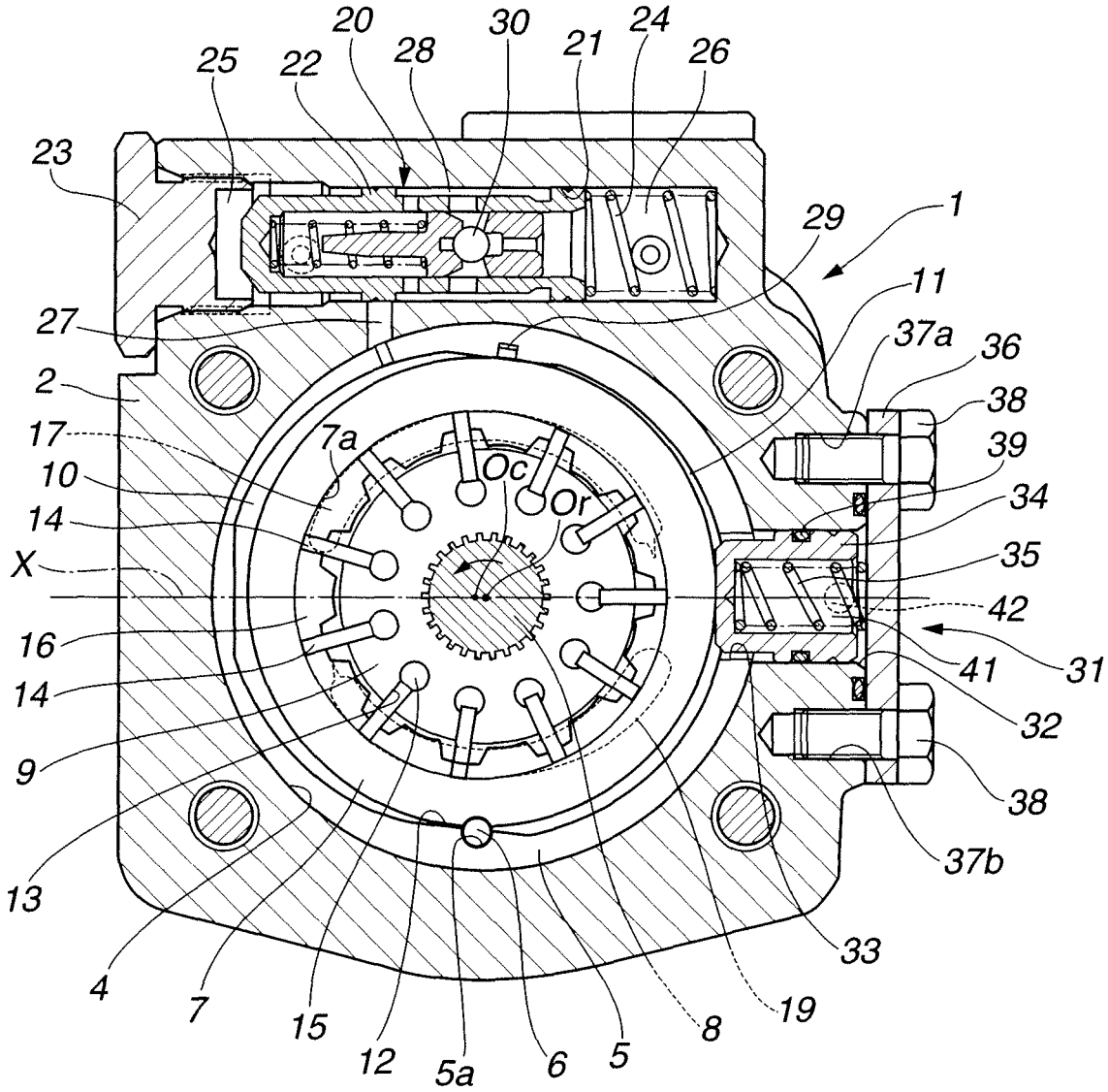
FIG. 4 is a cross-section of the variable displacement pump of the first embodiment, showing an operating position of the variable displacement pump of the first embodiment.
Figure 6:
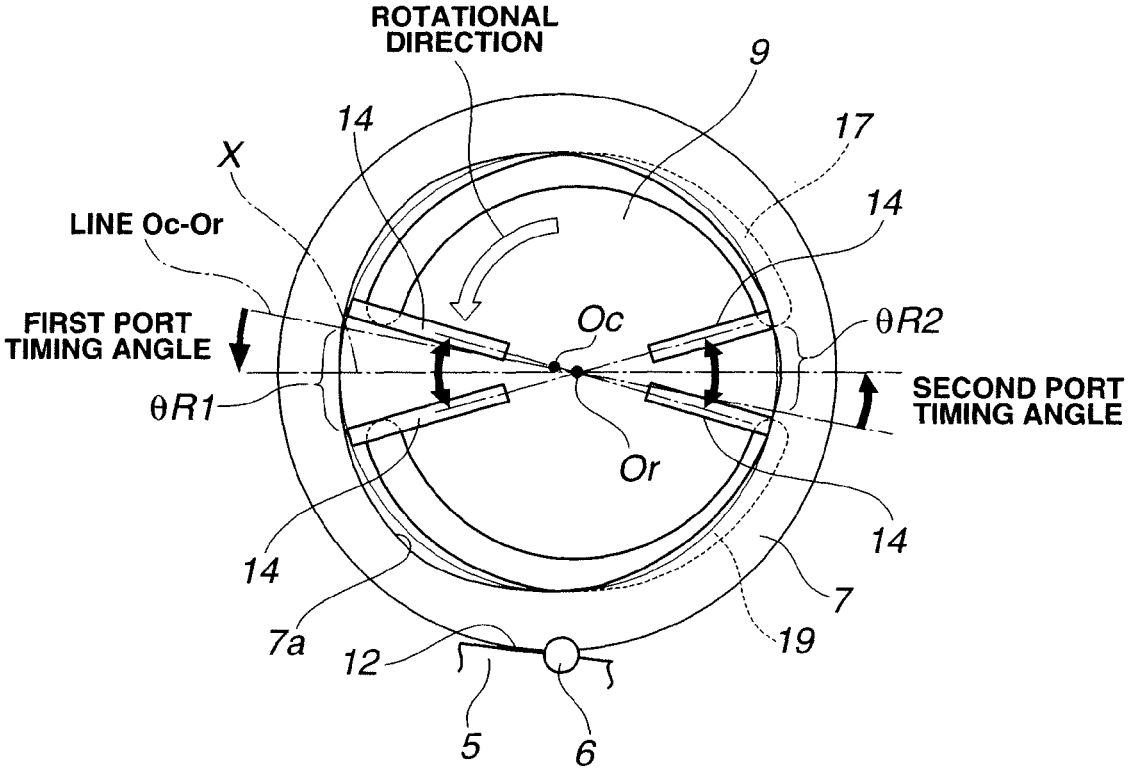
FIG. 6 is a schematic diagram showing a port timing in the variable displacement pump of the first embodiment.
Figure 7A:
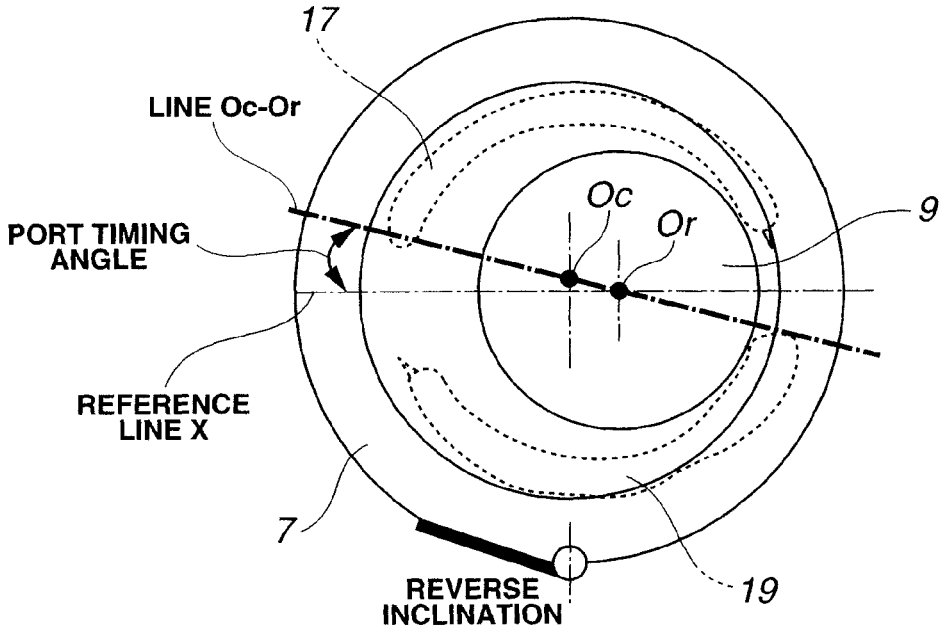
FIG. 7A is a schematic diagram showing a maximum eccentric state of the cam ring.
Figure 7B:
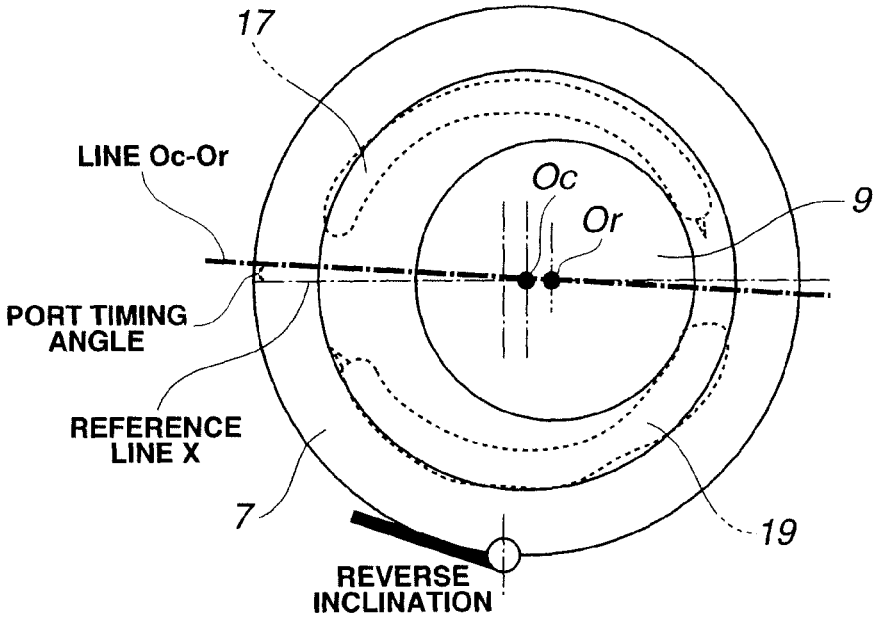
FIG. 7B is a schematic diagram showing a minimum eccentric state of the cam ring but omitting a rotor and vanes.

Referring to FIG. 1, FIG. 4, FIG. 6, FIG. 7A, and FIG. 7B, an operation of the variable displacement pump of the first embodiment is explained. FIG. 1 shows cam ring 7 in the maximum eccentric state. FIG. 4 shows cam ring 7 in the minimum eccentric state. FIG. 6 is a schematic diagram showing a port timing in the variable displacement pump of the first embodiment. FIG. 7A and FIG. 7B show a relation between the port timing and the maximum and minimum eccentric states of cam ring 7.

Upon assembling cam ring 7 to adapter ring 5, cam ring 7 is placed in an eccentric lift position where cam ring 7 is disposed in a vertically upwardly offset state (a lift state) with being in the maximum eccentric state. That is, in the eccentric lift position, center Oc of the oval cam profile of cam ring 7 is horizontally offset from center Or of rotor 9, i.e., rotation center Or of rotor 9, by a maximum eccentric amount and slightly vertically upwardly offset from a horizontal line passing through center Oc of rotor 9, toward the side of suction port 17. The lift state of cam ring 7 can be attained by forming fulcrum surface 12 of adapter ring 5 into an upwardly raised portion, or by forming cam ring 7 such that center Oc of the cam profile of cam ring 7 is vertically upwardly offset relative to a contact point between the outer circumferential surface of cam ring 7 and fulcrum surface 12 of adapter ring 5.

In FIG. 1 and FIG. 6, as vanes 14 are rotated in the same rotational direction as that of the pump, one vane 14 is moved to a closing position in which the vane 14 closes terminal end 17*a* of suction port 17 and the adjacent vane 14 located forwardly in the rotational direction is moved to a closing position in which the vane 14 closes initial end 19*a* of discharge port 19. Initial end 19*a* of discharge port 19 may be defined by a notch that is formed to orient toward terminal end 17*a* of suction port 17. First closed section θR1 is defined between the two closing positions of vanes 14 in which both terminal end 17*a* of suction port 17 and initial end 19*a* of discharge port 19 are closed by adjacent vanes 14 to thereby block fluid communication between pump chamber 16 formed between vanes 14, and suction port 17 and discharge port 19. As vanes 14 are further rotated in the same rotational direction as that of the pump, one vane 14 is moved to a closing position in which the vane 14 closes terminal end 19*b* of discharge port 19 and the adjacent vane 14 forwardly located is moved to a closing position in which the vane 14 closes initial end 17*b* of suction port 17. Second closed section θR2 is defined between the two closing positions of vanes 14 in which terminal end 19*b* of discharge port 19 and initial end 17*b* of suction port 17 are closed by vanes 14 to thereby block the fluid communication between pump chamber 16 formed between vanes 14, and suction port 17 and discharge port 19.

A port timing that is defined as a position of terminal end 17*a* of suction port 17 or a position of initial end 19*a* of discharge port 19 with respect to a rotational position of vane 14 varies along with the swing motion of cam ring 7. That is, an opening timing of suction port 17 and discharge port 19 and a closing timing thereof vary along with the swing motion of cam ring 7. A port timing line on a side of first closed section θR1 is defined by a line extending from center Or of rotor 9 to a point that is located offset from terminal end 17*a* of suction port 17 in the rotational direction of the pump by an angle of a half of a vane pitch (360/the number of vanes 14).

A port timing line on a side of second closed section θR2 is defined by a line extending from center Or of rotor 9 to a point that is located offset from terminal end 19*b* of discharge port 19 in the rotational direction of the pump by the angle of the half of the vane pitch. In this embodiment, the port timing lines are aligned with horizontal reference line X as shown in FIG. 1.

As shown in FIG. 6, a first port timing angle in first closed section θR1 is formed between line Oc-Or that passes through center Oc of the cam profile of cam ring 7 and center Or of rotor 9, and the port timing line on the side of first closed section θR1. A second port timing angle in second closed section θR2 is formed between line Oc-Or and the port timing line on the side of second closed section θR2.

In the eccentric lift position of cam ring 7, center Oc of the cam profile of cam ring 7 is positioned to be horizontally offset from center Or of rotor 9 toward the side of suction port 17 and slightly vertically upwardly offset from the horizontal line passing through center Oc of the cam profile and center Or of rotor 9, so that line Oc-Or passing through both center Oc and center Or is upwardly inclined relative to the port timing line, i.e., reference line X, to form the port timing angle of a predetermined magnitude therebetween.

Figure 8A:
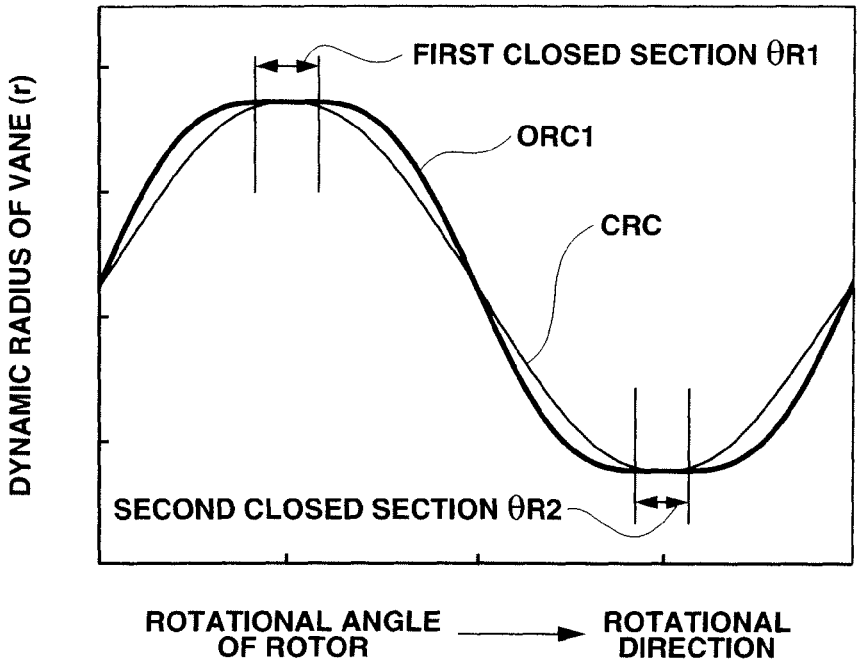
FIG. 8A is a diagram showing a relationship between a dynamic radius of a vane and a rotational angle of a rotor in the variable displacement pump of the first embodiment when the cam ring having the cam profile shown in FIG. 5A is placed in an eccentric no-lift state.

Variation of dynamic radius r of vane 14 when cam ring 7 having the oval cam profile shown in FIG. 5A is in the eccentric state but in a no-lift state and rotor 9 is rotated, is explained by referring to FIG. 8A. When rotor 9 is rotated in the rotational direction under the condition that center Oc of the oval cam profile of cam ring 7 is placed on reference line X without upward offset, namely, with zero port timing angle, and horizontally offset from center Ocr of rotor 9 by a predetermined eccentric amount toward the side of first closed section θR1, dynamic radius r of vane 14 varies as indicated by thick line curve ORC1 in FIG. 8A. In FIG. 8A, thick line curve ORC1 indicates a characteristic curve of dynamic radius r of vane 14 with respect to the rotational angle of rotor 9 when the cam profile defined by inner circumferential surface 7*a* of cam ring 7 has the oval shape as indicated by thick line in FIG. 5A, and thin line curve CRC indicates a characteristic curve of dynamic radius r of vane 14 with respect to the rotational angle of rotor 9 when the cam profile defined by inner circumferential surface 7*a* of cam ring 7 has the complete round shape as indicated by thin line in FIG. 5A. In the case where the cam profile of cam ring 7 is the oval cam profile shown in FIG. 5A, dynamic radius r of vane 14 in each of first closed section θR1 and second closed section θR2 is kept constant as indicated by characteristic curve ORC1 in FIG. 8A.

Figure 8B:
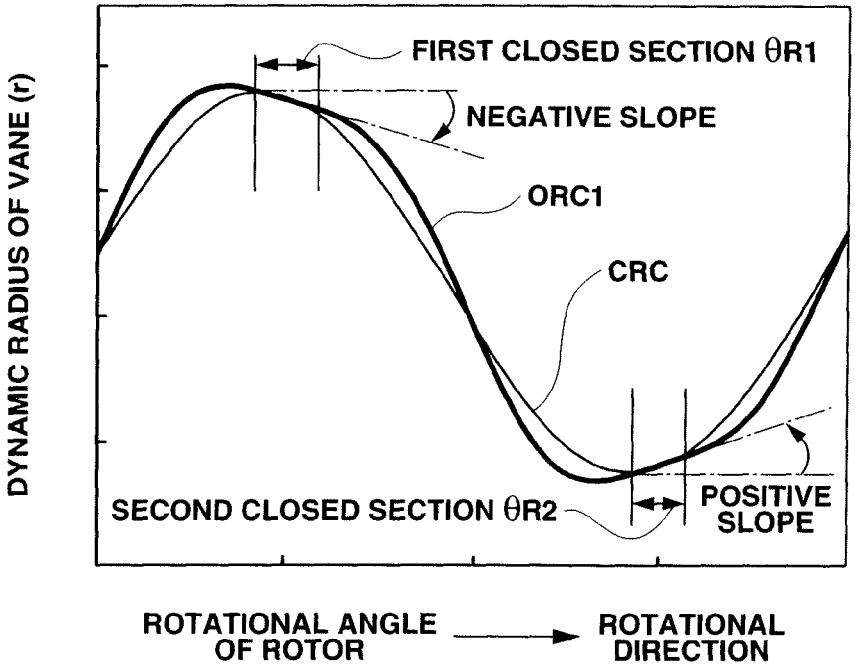
FIG. 8B is a diagram showing a relationship between the dynamic radius of the vane and the rotational angle of the rotor in the variable displacement pump of the first embodiment when the cam ring having the cam profile shown in FIG. 5A is placed in an eccentric lift state.

Next, variation of dynamic radius r of vane 14 when cam ring 7 having the oval cam profile shown in FIG. 5A is in the above-described eccentric lift position and rotor 9 is rotated, is explained by referring to FIG. 8B. In the eccentric lift position shown in FIG. 7A, center Oc of the oval cam profile of cam ring 7 is horizontally offset from center Or of rotor 9 toward the side of suction port 17 and vertically upwardly offset from the horizontal line passing through center Or of rotor 9 by the predetermined lift amount to thereby provide the port timing angle of the predetermined magnitude. When rotor 9 is rotated in the rotational direction under the condition that cam ring 7 is placed in the eccentric lift position, dynamic radius r of vane 14 varies as indicated by thick line curve ORC1 in FIG. 8B. In FIG. 8B, thick line curve ORC1 indicates a characteristic curve of dynamic radius r of vane 14 with respect to the rotational angle of rotor 9 when the cam profile of cam ring 7 has the oval shape as indicated by thick line in FIG. 5A, and thin line curve CRC indicates a characteristic curve of dynamic radius r of vane 14 with respect to the rotational angle of rotor 9 when the cam profile of cam ring 7 has the complete round shape as indicated by thin line in FIG. 5A. In the case where the cam profile of cam ring 7 has the oval shape shown in FIG. 5A, in first closed section θR1, dynamic radius r of vane 14 as indicated by characteristic curve ORC1 becomes large on an upper side of first closed section θR1 (namely, on a side of a starting point of first closed section θR1 in the rotational direction of rotor 9) and gradually decreases in the rotational direction of rotor 9. Thus, characteristic curve ORC1 of dynamic radius r of vane 14 with respect to the rotational angle of rotor 9 has a negative slope in first closed section θR1. On the other hand, in second closed section θR2, dynamic radius r of vane 14 as indicated by characteristic curve ORC1 becomes large on an upper side of second closed section θR2 (namely, a side of a terminal point of second closed section θR2 in the rotational direction of rotor 9) and gradually increases in the rotational direction of rotor 9. Thus, characteristic curve ORC1 of dynamic radius r of vane 14 with respect to the rotational angle of rotor 9 has a positive slope in second closed section θR2. The magnitude of the respective slopes varies in proportion to an amount of the upward offset of cam ring 7.

If an eccentric amount of center Oc of the oval cam profile of cam ring 7 with respect to center Oc of rotor 9 is larger than the predetermined eccentric amount, characteristic curve ORC1 of dynamic radius r of vane 14 in each of first and second closed sections R1 and R2 varies from a straight line to a slightly convex curve. In contrast, the eccentric amount of center Oc of the oval cam profile of cam ring 7 with respect to center Oc of rotor 9 is smaller than the predetermined eccentric amount, characteristic curve ORC1 of dynamic radius r of vane 14 in each of first and second closed sections R1 and R2 varies from the straight line to a slightly concave curve. The magnitude of the respective slopes varies in proportion to the lift amount of cam ring 7, i.e., the lift amount of center Oc of the oval cam profile.

When cam ring 7 that has the oval cam profile defined by inner circumferential surface 7*a* is assembled to adapter ring 5 that has fulcrum surface 12 with the reverse inclination, cam ring 7 is placed in the eccentric lift position where cam ring 7 is in the large lift state with keeping in the maximum eccentric state. In the maximum eccentric state, the eccentric amount, i.e., the horizontally offset amount, of center Oc of the oval cam profile is the maximum. In the large lift state, the lift amount, i.e., the upwardly offset amount, of center Oc of the oval cam profile is relatively large, namely, the magnitude of the port timing angle is relatively large as shown in FIG. 6 and FIG. 7A. When cam ring 7 having the oval cam profile is swung on fulcrum surface 12 to move from the maximum eccentric state to the minimum eccentric state via the medium eccentric state upon rotation of rotor 9, the lift amount and the eccentric amount of center Oc of the oval cam profile of cam ring 7 are gradually decreased as seen from FIG. 7A and FIG. 7B. When the eccentric state of cam ring 7 is changed from the maximum eccentric state to the medium eccentric state and the minimum eccentric state along with the swing motion of cam ring 7, characteristic curve ORC1 of dynamic radius r of vane 14 with respect to the rotational angle of rotor 9 varies such that the magnitude of the negative slope in first closed section θR1 is gradually reduced as the eccentric amount of center Oc of the oval cam profile of cam ring 7 is decreased.

On the other hand, when the eccentric state of cam ring 7 is changed from the maximum eccentric state to the minimum eccentric state via the medium eccentric state along with the swing motion of cam ring 7, characteristic curve ORC1 of dynamic radius r of vane 14 with respect to the rotational angle of rotor 9 varies such that the magnitude of the positive slope in second closed section θR2 is gradually reduced as the eccentric amount of center Oc of the oval cam profile of cam ring 7 is decreased.

The magnitude of the negative slope in first closed section θR1 can be controlled by adjusting the lift amount of cam ring 7 in the maximum eccentric state of cam ring 7. A rate of reduction in the magnitude of the negative slope in first closed section θR1 which is caused along with the swing motion of cam ring 7 can be controlled by adjusting the lift amount of cam ring 7 in the maximum eccentric state which is based on an inclination angle of the reverse inclination of fulcrum surface 12.

Since the lift amount of cam ring 7 varies in proportion to the port timing angle, the magnitude of the negative slope in first closed section θR1 and the rate of reduction in the magnitude of the negative slope in first closed section θR1 along with the swing motion of cam ring 7 can be controlled by adjusting the port timing angle and a rate of reduction in the port timing angle.

In other words, the port timing (or the port timing line) that is defined as a position of terminal end 17*a* of suction port 17 or initial end 19*a* of discharge port 19 with respect to a rotational position of vane 14 is controlled so as to vary along with the swing motion of cam ring 7. That is, the port timing angle relative to line Oc-Or is controlled so as to vary along with the swing motion of cam ring 7.

[Control of Negative Slope in Second Closed Section]

Characteristic curve ORC1 of dynamic radius r of vane 14 has the positive slope in second closed section θR2 as shown in FIG. 8B. However, since dynamic radius r of vane 14 in second closed section θR2 varies in proportion to the lift amount of cam ring 7, characteristic curve ORC1 of dynamic radius r of vane 14 in second closed section θR2 can be controlled to a negative slope by changing the cam profile of cam ring 7 to an oval cam profile as shown in FIG. 5B.

Figure 5B:
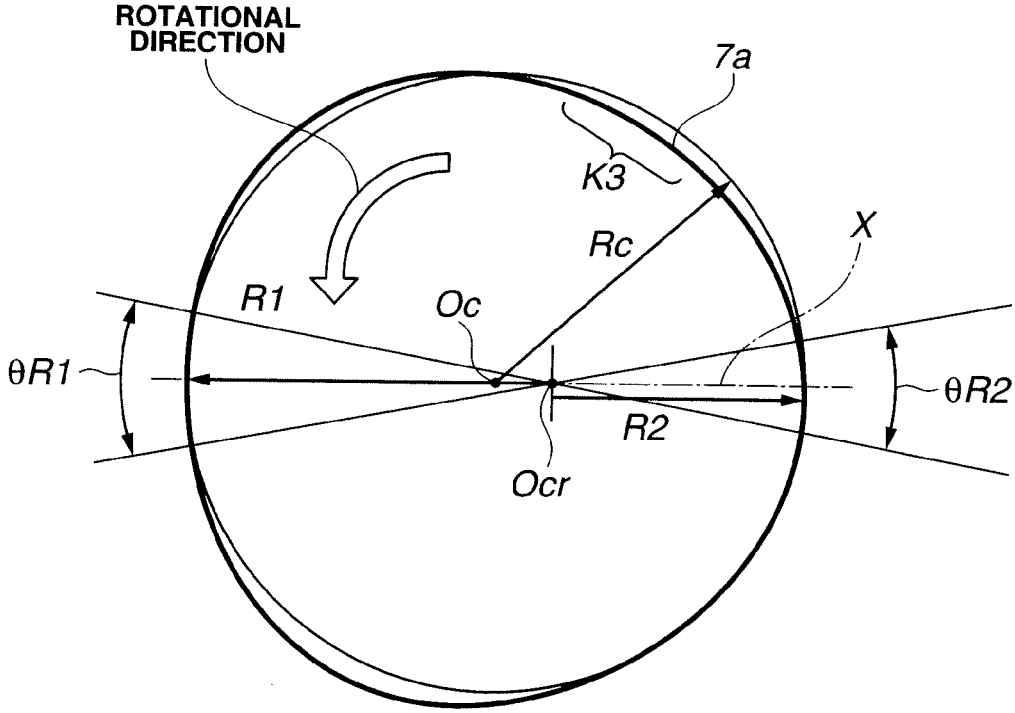
Figure 9A:
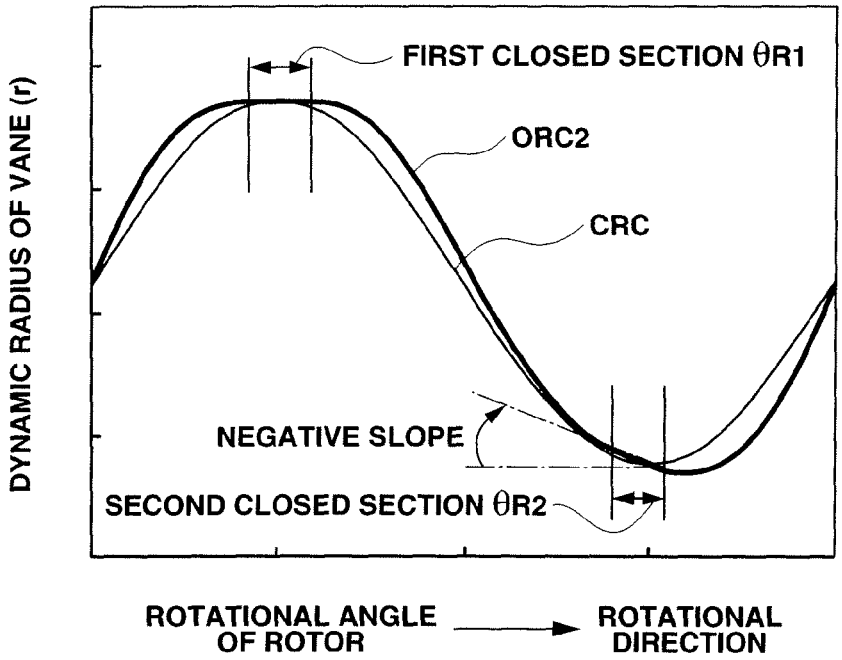
FIG. 9A is a diagram showing a relationship between the dynamic radius of the vane and the rotational angle of the rotor in the variable displacement pump of the first embodiment when the cam ring having the cam profile shown in FIG. 5B is placed in an eccentric no-lift state.

FIG. 5B shows the oval cam profile of cam ring 7 which is defined by inner circumferential surface 7*a* of cam ring 7 and provides the negative slope in second closed section θR2 of characteristic curve ORC1 of dynamic radius r of vane 14 with respect to the rotational angle of rotor 9 as shown in FIG. 9A. In FIG. 5B, a thick line indicates the oval cam profile of cam ring 7 which has a center Oc, and a thin line indicates a complete round as a reference circle which is centered at center Oc and has radius Rc. The oval cam profile has a first curve extending over first closed section θR1, a second curve extending over second closed section θR2, and transition curve K3 that extends between the first curve and the second curve and connects the first curve and the second curve with each other. The first curve includes a part of a first circle that is centered at point Ocr and has radius R1. Point Ocr indicates a position of the center of rotor 9 from which center Oc of the oval cam profile of cam ring 7 is horizontally offset by a predetermined eccentric amount toward the side of first closed section θR1. The second curve includes a part of a second circle that is centered at a point vertically downwardly offset from center Ocr of rotor 9 by a predetermined amount and has radius R2. The oval cam profile shown in FIG. 5B is configured similar to the oval cam profile shown in FIG. 5A except for the above-described feature.

FIG. 9A shows variation in dynamic radius r of vane 14 along with the rotation of rotor 9 under the condition that cam ring 7 having the oval cam profile shown in FIG. 5B is assembled to adapter ring 5 so as to be placed in the eccentric no-lift state. In the eccentric no-lift state, center Oc of the oval cam profile is placed on reference line X, namely, with the port timing angle of zero, and horizontally offset from center Or of rotor 9 by a predetermined eccentric amount toward the side of first closed section θR1. When cam ring 7 having the oval cam profile shown in FIG. 5B is thus assembled and rotor 9 is rotated in the rotational direction, dynamic radius r of vane 14 varies as indicated by thick line curve ORC2 in FIG. 9A. In FIG. 9A, thick line curve ORC2 indicates a characteristic curve of dynamic radius r of vane 14 with respect to the rotational angle of rotor 9 when cam ring 7 has the oval cam profile shown in FIG. 5B, and thin line curve CRC indicates a characteristic curve of dynamic radius r of vane 14 with respect to the rotational angle of rotor 9 when an inner circumferential surface of cam ring 7 has the complete round-shaped cam profile shown in FIG. 5A. In the case where cam ring 7 has the oval cam profile shown in FIG. 5B, characteristic curve ORC2 of dynamic radius r of vane 14 has no slope in first closed section θR1 as indicated by a lateral straight line segment but has a negative slope in second closed section θR2 as shown in FIG. 9A.

Figure 9B:
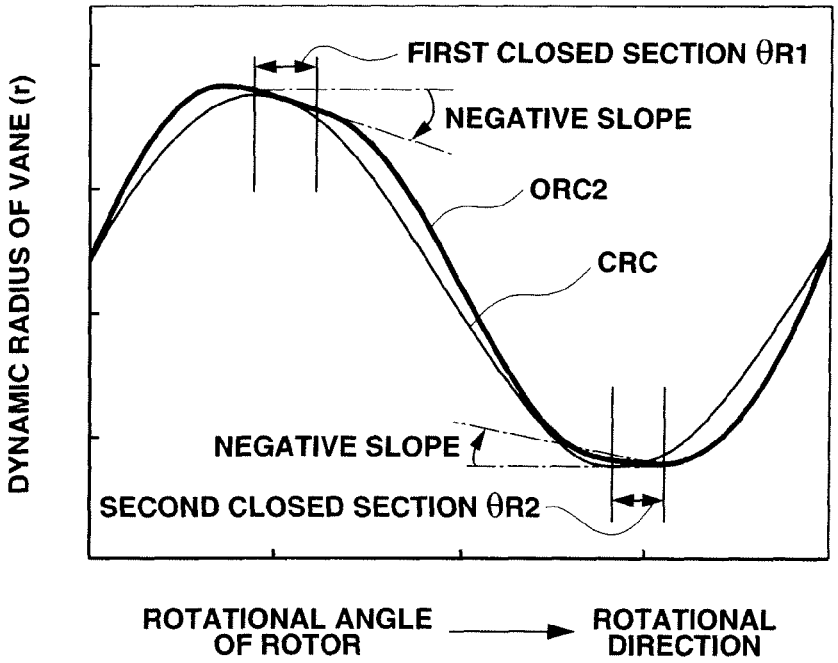
FIG. 9B is a diagram showing a relationship between the dynamic radius of the vane and the rotational angle of the rotor in the variable displacement pump of the first embodiment when the cam ring having the cam profile shown in FIG. 5B is placed in an eccentric lift state.

FIG. 9B shows variation in dynamic radius r of vane 14 along with the rotation of rotor 9 under the condition that cam ring 7 having the oval cam profile shown in FIG. 5B is assembled to adapter ring 5 such that cam ring 7 is placed in the eccentric lift state. That is, in the eccentric lift state, center Oc of the oval cam profile is horizontally offset from center Or of rotor 9 by the predetermined eccentric amount toward the side of first closed section θR1 and vertically upwardly offset from the horizontal line passing through center Or of rotor 9 toward the side of suction port 17 by a slight lift amount to thereby provide the port timing angle of a predetermined magnitude. In FIG. 9B, thick line curve ORC2 indicates a characteristic curve of dynamic radius r of vane 14 with respect to the rotational angle of rotor 9 when cam ring 7 has the oval cam profile shown in FIG. 5B, and thin line curve CRC indicates a characteristic curve of dynamic radius r of vane 14 with respect to the rotational angle of rotor 9 when cam ring 7 has the complete round-shaped cam profile shown in FIG. 5B. In the case where cam ring 7 having the oval cam profile shown in FIG. 5B is in the assembled state with the port timing angle of the predetermined magnitude as described above, characteristic curve ORC2 of dynamic radius r of vane 14 with respect to the rotational angle of rotor 9 has a negative slope in each of first closed section θR1 and second closed section θR2 as shown in FIG. 9B.

Figure 10:
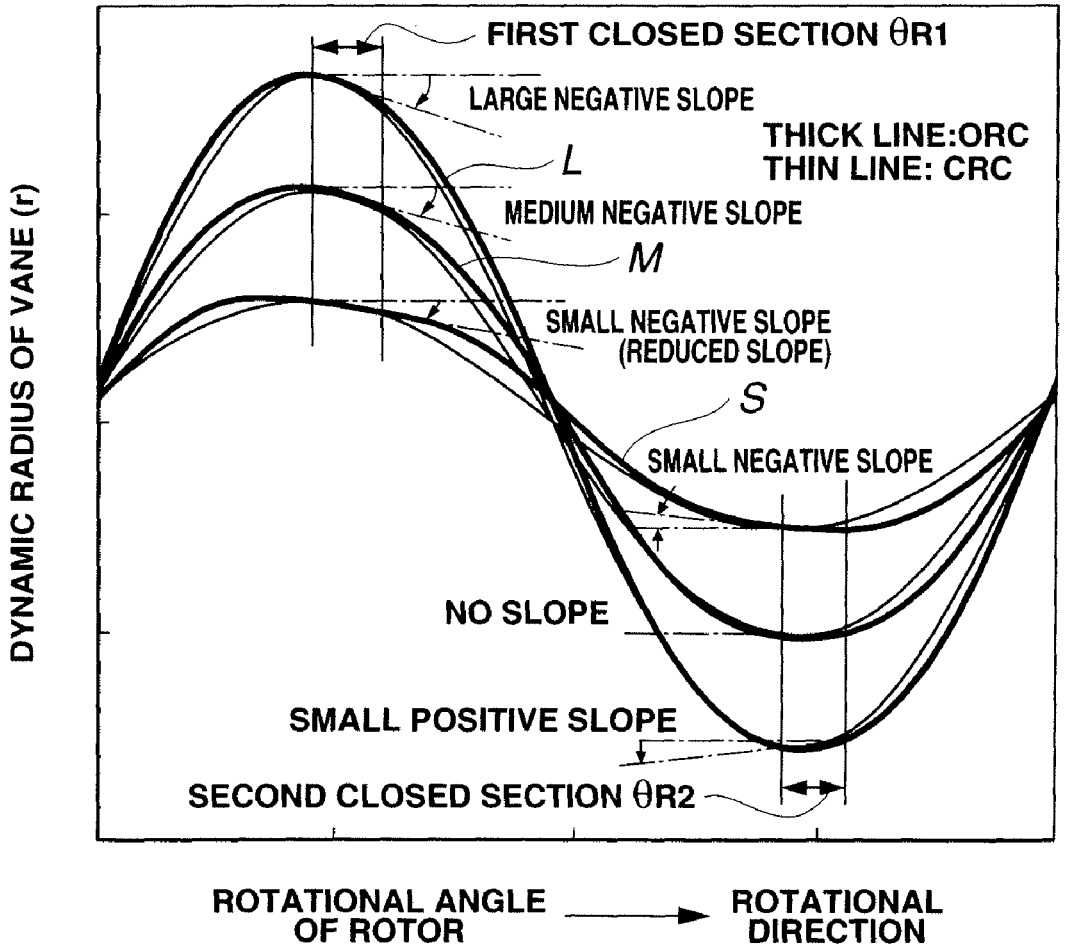
FIG. 10 is a diagram illustrating a relationship between the dynamic radius of the vane and the rotational angle of the rotor in the variable displacement pump of the first embodiment when the cam ring having the cam profile shown in FIG. 5B is controlled from the maximum eccentric state to the minimum eccentric state upon being assembled to an adapter ring having a fulcrum surface with a reverse inclination.

FIG. 10 shows variation in dynamic radius r of vane 14 which is caused when cam ring 7 having the oval cam profile shown in FIG. 5B is swung on fulcrum surface 12 of adapter ring 5 between the maximum eccentric state, the medium eccentric state and the minimum eccentric state along with the rotation of rotor 9. In FIG. 10, three thick line curves ORC indicate characteristic curves of dynamic radius r of vane 14 with respect to the rotational angle of rotor 9 as indicated at L, M and S, respectively. Characteristic curves L, M and S are exhibited when cam ring 7 having the oval cam profile shown in FIG. 5B is placed in the maximum eccentric state, the medium eccentric state and the minimum eccentric state, respectively. Thin line curves CRC extending adjacent along thick line curves ORC indicate characteristic curves of dynamic radius r of vane 14 with respect to the rotational angle of rotor 9 which are exhibited when cam ring 7 having the complete round-shaped cam profile is placed in the maximum eccentric state, the medium eccentric state and the minimum eccentric state, respectively. A magnitude of the negative slope in second closed section θR2 of characteristic curve ORC of dynamic radius r of vane 14 with respect to the rotational angle of rotor 9 can be controlled by adjusting an initial magnitude of the negative slope which is set by the oval cam profile of cam ring 7 as shown in FIG. 5B, that is, by adjusting the vertically downwardly offset amount of the center of the second circle of the oval cam profile. A rate of increase in the magnitude of the negative slope in second closed section θR2 can be controlled by adjusting an inclination angle of the reverse inclination on fulcrum surface 12, that is, the vertically downwardly offset amount of center Oc of the oval cam profile of cam ring 7 as shown in FIG. 5B.

Accordingly, the magnitude of the negative slope in second closed section θR2 on characteristic curve ORC of dynamic radius r of vane 14 with respect to the rotational angle of rotor 9 can be controlled by adjusting the initial magnitude of the negative slope which is set by the oval cam profile of cam ring 7 shown in FIG. 5B, that is, the vertically downwardly offset amount of the center of the second circle having radius R2, and by adjusting the upwardly offset amount of center Oc of the oval cam profile shown in FIG. 5B when cam ring 7 is assembled to adapter ring 5, that is, by adjusting the port timing angle. Variation such as increase in the magnitude of the negative slope can be controlled by adjusting a rate of reduction in the vertically upwardly offset amount of center Oc of the oval cam profile shown in FIG. 5B (a rate of reduction in the port timing angle). In other words, the port timing (or the port timing line) that is defined as the position of terminal end 17*a* of suction port 17 or initial end 19*a* of discharge port 19 with respect to the rotational position of vane 14 is controlled so as to vary along with the swing motion of cam ring 7. That is, the port timing angle relative to line Oc-Or is controlled so as to vary along with the swing motion of cam ring 7.

An operation of the variable displacement pump of the first embodiment will be explained hereinafter. When the variable displacement pump is rotated at a low speed, a low fluid pressure on the suction side is introduced from control valve 20 into first fluid pressure chamber 10 and second fluid pressure chamber 11. In this state, cam ring 7 is urged by the pressing force of plunger 34 to swing about the swing fulcrum on fulcrum surface 12 toward first fluid pressure chamber 10 as shown in FIG. 1 and FIG. 6. The eccentric amount of cam ring 7 relative to rotor 9 becomes maximum so that an amount of the working fluid that is discharged from the variable displacement pump (referred to merely as a discharge amount of the pump) is increased.

When the pump rotation speed reaches a predetermined value or more at high speed region, the discharge amount of the pump is further increased to thereby cause an increase in the difference between a fluid pressure on the upstream side of the metering orifice and a fluid pressure on the downstream side of the metering orifice. Spool valve 22 is urged to move in the rightward direction in FIG. 4 against the spring force of valve spring 24 so that the high fluid pressure in high-pressure chamber 25 of control valve 20 is introduced into first fluid pressure chamber 10. Cam ring 7 is urged by the high fluid pressure to swingingly move toward second fluid pressure chamber 11 against the pressing force of plunger 34 as shown in FIG. 4, so that the eccentric amount of cam ring 7 relative to rotor 9 is decreased. As a result, the discharge amount of the pump is reduced to a minimum required amount and an optimal discharge characteristic of the pump can be obtained.

As described above, cam ring 7 having the oval cam profile shown in FIG. 5A is assembled to adapter ring 5 having fulcrum surface 12 with the reverse inclination in such a manner that cam ring 7 is placed in the vertically upwardly offset position shown in FIG. 6 and FIG. 7A in which the relatively large port timing angle is formed, while being kept in the maximum eccentric state shown in FIG. 1. Cam ring 7 is swung on fulcrum surface 12 and displaced from the maximum eccentric state to the medium eccentric state and the minimum eccentric state as shown in FIG. 4 and FIG. 7B by the fluid pressure in first fluid pressure chamber 10.

Figure 11:
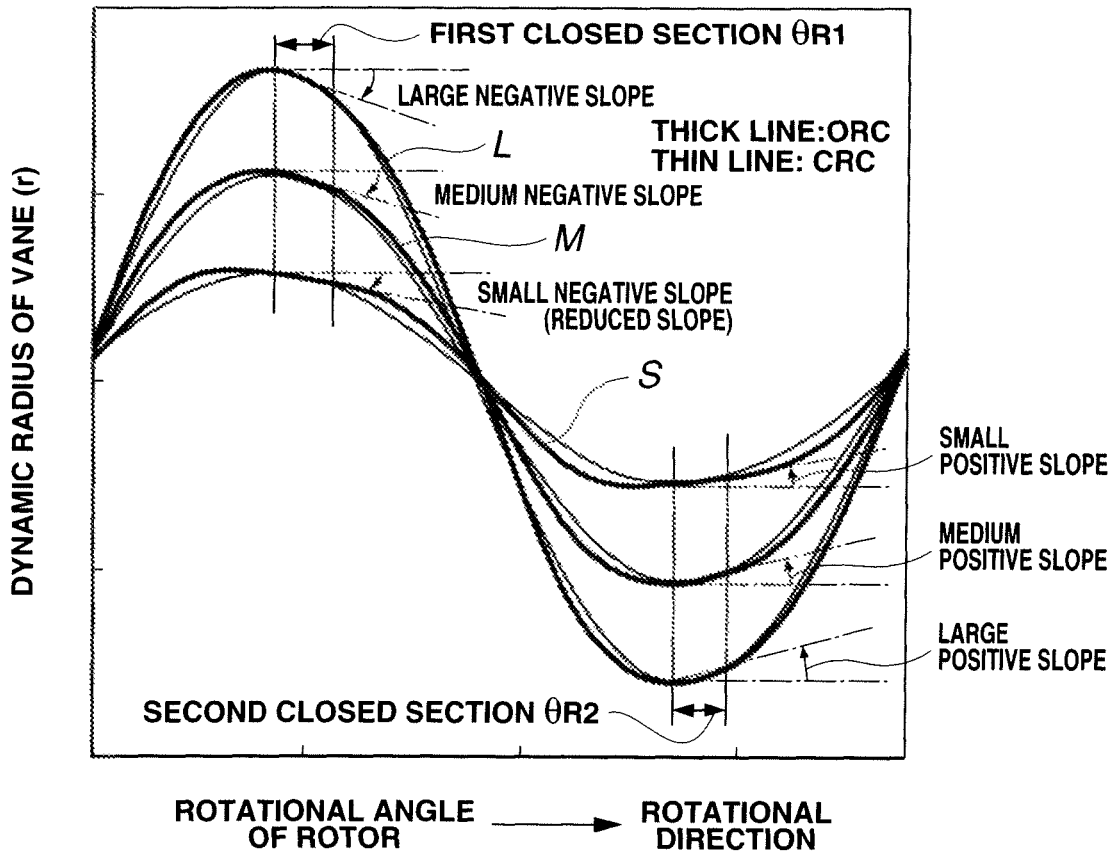
FIG. 11 is a diagram similar to FIG. 10, except that the cam ring has the cam profile shown in FIG. 5A.

Along with the swing motion of cam ring 7, dynamic radius r of vane 14 varies as indicated by characteristic curves L, M and S in FIG. 11. The magnitude of the negative slope in first closed section θR1 of characteristic curve L of dynamic radius r of vane 14 in the maximum eccentric state of cam ring 7 becomes large in proportion to the magnitude of the port timing angle shown in FIG. 7A which varies along with change in the upwardly offset amount, i.e., the upwardly offset amount of center Oc of the oval cam profile. As cam ring 7 is displaced from the maximum eccentric state toward the minimum eccentric state along fulcrum surface 12, the eccentric amount and the upwardly offset amount of cam ring 7 are reduced and the port timing angle is decreased as shown in FIG. 7B. Owing to the displacement of cam ring 7 toward the minimum eccentric state, dynamic radius r of vane 14 in first closed section θR1 is gradually decreased and the magnitude of the negative slopes in first closed section θR1 as indicated by characteristic curves M and S is also reduced.

In first closed section θR1, as seen from in FIG. 1 and FIG. 6, pump chamber 16 between adjacent two vanes 14 in the rotational direction of rotor 9 is isolated from both a suction fluid pressure on the suction side and a discharge fluid pressure on the discharge side, so that the fluid pressure in pump chamber 16 is set at an intermediate fluid pressure between the suction fluid pressure and the discharge fluid pressure. The fluid pressure in pump chamber 16 varies as vanes 14 rotatively move and pass through first closed section θR1 along with the rotation of rotor 9. The fluid pressure in pump chamber 16 is kept at the suction fluid pressure before terminal end 17*a* of suction port 17 is closed by the rearward vane 14 in the rotational direction of vanes 14 and the forward vane 14 in the rotational direction of vanes 14 passes through and opens initial end 19*a* or the notch of discharge port 19 along with the rotation of vanes 14. The fluid pressure in pump chamber 16 is kept at the intermediate fluid pressure from the moment terminal end 17*a* of suction port 17 is closed by the rearward vane 14 to the moment the forward vane 14 passes through and opens initial end 19*a* or the notch of discharge port 19 along with the rotation of vanes 14. The fluid pressure in pump chamber 16 is kept at the discharge fluid pressure after the forward vane 14 passes through and opens initial end 19*a* or the notch of discharge port 19 and before the rearward vane 14 passes through and opens initial end 19*a* or the notch of discharge port 19 along with the rotation of vanes 14. When vanes 14 pass through first closed section θR1 along with the rotation of rotor 9, the suction fluid pressure, the intermediate fluid pressure and the discharge fluid pressure sequentially act on a front side of each of the adjacent two vanes 14, 14 and a rear side thereof in the rotational direction of vanes 14. Due to a differential pressure between the front side of vane 14 and the rear side of vane 14, vane 14 is urged to slant rearward in the rotational direction of rotor 9 with respect to slot 13 of rotor 9 and press on a wall that defines slot 13. This causes slide resistance between vane 14 in the slant state and rotor 9. In this condition, if there is provided a positive slope of the characteristic curve of dynamic radius r of vane 14 in first closed section θR1 in which dynamic radius r of vane 14 is gradually increased, the projecting movement of vane 14 relative to slot 13 is disturbed due to the slide resistance between vane 14 in the slant state and rotor 9 and thereby the leading edge of vane 14 is caused to separate apart from the inner circumferential surface of cam ring 7. This leads to increase in pulsation in fluid pressure, thereby causing increase in vibration and noise in the pump.

In contrast, in this embodiment, characteristic curves L, M and S of dynamic radius r of vane 14 with respect to the rotational angle of rotor 9 has the negative slope in first closed section θR1 as explained above. Owing to the negative slope in first closed section θR1, vane 14 is always pushed into slot 13 by cam ring 7 in first closed section θR1 to thereby suppress separation between the leading edge of vane 14 and inner circumferential surface 7*a* of cam ring 7. Further, owing to the negative slope in first closed section θR1, the volume of pump chamber 16 between the adjacent two vanes 14, 14 in first closed section θR1 is reduced along with the rotation of rotor 9 and thereby the intermediate fluid pressure in pump chamber 16 is previously compressed and pressurized. A magnitude of the pressure that is applied to the intermediate fluid pressure becomes larger in proportion to the magnitude of the negative slope.

In the case where the variable displacement pump of this embodiment is applied to a power steering apparatus, when the pump discharge pressure is high upon operating a steering wheel at a low vehicle speed and at a low rotation speed of the pump (in the maximum eccentric state of cam ring 7), the magnitude of the negative slope of characteristic curve L of dynamic radius r of vane 14 in first closed section θR1 becomes larger to thereby cause large preliminary compression of the intermediate fluid pressure in pump chamber 16 in first closed section θR1. As a result, the intermediate fluid pressure in pump chamber 16 in first closed section θR1 is smoothly increased and changed to the discharge pressure, and therefore, it is possible to suppress an impact that is caused due to a rapid increase in the intermediate fluid pressure, and vibration in the pump due to the impact. Further, with the provision of the negative slope of characteristic curve L of dynamic radius r of vane 14 in first closed section θR1, vane 14 is urged by cam ring 7 so as to retreat into slot 13 of rotor 9, so that separation of the leading edge of vane 14 from inner circumferential surface 7*a* of cam ring 7 in first closed section θR1 can be suppressed and pulsation in fluid pressure which is caused by the separation can be prevented. The separation of the leading edge of vane 14 from inner circumferential surface 7*a* of cam ring 7 is caused due to slide resistance that is generated between vane 14 and rotor 9 when the differential pressure between the front side of vane 14 and the rear side of vane 14 in the rotational direction of vane 14 acts on the front surface of vane 14 and the rear surface of vane 14.

When the pump discharge pressure is low upon straight traveling of the vehicle at medium rotation speed and high rotation speed of the pump (in the medium eccentric state and the minimum eccentric state of cam ring 7), the magnitude of the negative slope of characteristic curves M, S of dynamic radius r of vane 14 in first closed section θR1 is decreased as shown in FIG. 11 along with reduction of the eccentric amount of cam ring 7. The decrease in the magnitude of the negative slope causes reduction in preliminary compression of the intermediate fluid pressure in pump chamber 16 in first closed section θR1. The intermediate fluid pressure in pump chamber 16 is smoothly increased, so that smooth transition from the intermediate fluid pressure in pump chamber 16 to the small discharge pressure is performed. Therefore, it is possible to suppress an impact that is caused due to a rapid increase in the intermediate fluid pressure, and vibration in the pump due to the impact. Further, owing to the negative slope of characteristic curves M, S of dynamic radius r of vane 14 in first closed section θR1, vane 14 is urged by cam ring 7 so as to retreat into slot 13 of rotor 9. As a result, separation of the leading edge of vane 14 from inner circumferential surface 7*a* of cam ring 7 in first closed section θR1, and pulsation in fluid pressure which is caused by the separation, can be suppressed.

Further, cam ring 7 has the predetermined cam profile shown in FIG. 5A or FIG. 5B and assembled to adapter ring 5 such that cam ring 7 is placed in the eccentric lift position on fulcrum surface 12 in which cam ring 7 has the predetermined eccentric amount and the predetermined lift amount as explained above. The port timing angle (the port timing) can be changed along with the swing motion of cam ring 7. Accordingly, in the power steering apparatus using the variable displacement pump of this embodiment, it is possible to reduce pulsation, vibration and noise over the entire operating region of the pump.

[Second Closed Section]

In the case where cam ring 7 having the oval cam profile shown in FIG. 5A is placed in the eccentric lift position as shown in FIG. 6 and FIG. 7B, characteristic curve ORC1 of dynamic radius r of vane 14 relative to the rotation angle of rotor 9 has the positive slope in second closed section θR2 as shown in FIG. 8B. Further, when cam ring 7 is assembled to adapter ring 5 and swung on fulcrum surface 12 with the reverse inclination to change the eccentric state from the maximum to the minimum, the magnitude of the positive slope in second closed section θR2 is gradually decreased as shown in FIG. 11 along with reduction of the lift amount of cam ring 7, namely, reduction of the port timing angle.

When being located in second closed section θR2, pump chamber 16 between adjacent two vanes 14 in the rotational direction of rotor 9 is isolated from both the suction fluid pressure on the suction side and the discharge fluid pressure on the discharge side. The fluid pressure in pump chamber 16 is kept at the intermediate fluid pressure between the suction fluid pressure and the discharge fluid pressure from the moment at which terminal end 19*b* of discharge port 19 is closed by the rearward vane 14 in the rotational direction of vanes 14 to the moment at which the forward vane 14 in the rotational direction of vanes 14 passes through and opens initial end 17*b* or the notch of suction port 17. The fluid pressure in pump chamber 16 sequentially varies from the discharge fluid pressure to the suction fluid pressure via the intermediate fluid pressure as vanes 14 rotatively move and pass through second closed section θR2 along with the rotation of rotor 9. Similar to first closed section θR1 as explained above, in second closed section θR2, vane 14 is urged to slant forward in the rotational direction of vanes 14 with respect to slot 13 of rotor 9 due to the differential pressure between the front side of vane 14 and the rear side of vane 14. There occurs slide resistance between vane 14 in the slant state and rotor 9, whereby the projecting movement of vane 14 relative to slot 13 is disturbed to cause separation of the leading edge of vane 14 from the inner circumferential surface of cam ring 7. Therefore, it is desirable that the characteristic curve of dynamic radius r of vane 14 with respect to the rotational angle of rotor has zero or a negative slope in order to suppress the separation of the leading edge of vane 14 from the inner circumferential surface of cam ring 7.

Further, the fluid pressure in pump chamber 16 in second closed section θR2 varies from the discharge fluid pressure to the suction fluid pressure via the intermediate fluid pressure. In order to perform smooth transition from the discharge fluid pressure to the intermediate fluid pressure and from the intermediate fluid pressure to the suction fluid pressure, it is desirable that preliminary expansion of the fluid pressure in pump chamber 16 in second closed section θR2 (large magnitude of positive slope of the characteristic curve of dynamic radius r of vane 14 in second closed section θR2) is large in a case where the discharge fluid pressure is high, whereas the preliminary expansion of the fluid pressure in pump chamber 16 in second closed section θR2 (small magnitude of positive slope of the characteristic curve of dynamic radius r of vane 14 in second closed section θR2) is small in a case where the discharge fluid pressure is low.

In the power steering apparatus using the variable displacement pump of this embodiment, it is possible to perform smooth drop in fluid pressure and suppress hydraulic impact, vibration and noise over the entire operating region of the pump. When the pump discharge pressure is high upon operating the steering wheel at low vehicle speed and at low pump rotation speed (in the maximum eccentric state of cam ring 7), there is provided a slightly large magnitude of the positive slope of characteristic curve of dynamic radius r of vane 14 with respect to the rotational angle of rotor 9 in second closed section θR2 in order to produce the intermediate fluid pressure that allows smooth drop in fluid pressure and suppresses separation of the leading edge of vane 14 from the inner circumferential surface of cam ring 7. As a result, the separation of the leading edge of vane 14 from the inner circumferential surface of cam ring 7 can be prevented while minimizing the projecting amount of vane 14 relative to slot 13.

[Negative Slope in Second Closed Section]

When the pump discharge pressure is low upon straight traveling of the vehicle at medium rotation speed and high rotation speed of the pump (in the medium eccentric state and the minimum eccentric state of cam ring 7), it is desirable that characteristic curves M, S of dynamic radius r of vane 14 with respect to the rotational angle of rotor 9 in second closed section θR2 has no slope and the negative slope as shown in FIG. 10, respectively. For this purpose, the cam profile of cam ring 7 is formed into the oval shape shown in FIG. 5B which determines the initial magnitude of the negative slope in second closed section θR2. When cam ring 7 having the oval cam profile shown in FIG. 5B is assembled to adapter ring 5 and placed in the eccentric no-lift state in which center Oc of the oval cam profile is horizontally offset from center Or of rotor 9 toward the side of first closed section θR1 by a predetermined small eccentric amount without being upwardly offset relative to the horizontal line passing through center Or of rotor 9, dynamic radius r of vane 14 upon rotating rotor 9 in the rotational direction at zero reverse inclination angle varies as indicated by thick line curve ORC2 in FIG. 9A. As shown in FIG. 9A, characteristic curve ORC2 of dynamic radius r of vane 14 with respect to the rotational angle of rotor 9 has no slope in first closed section θR1 as indicated by the lateral straight line segment but has the negative slope in second closed section θR2 due to the initial magnitude of the negative slope set by the cam profile shown in FIG. 5B.

In contrast, when cam ring 7 having the oval cam profile shown in FIG. 5B is assembled to adapter ring 5 so as to be placed in the above-explained eccentric lift state on fulcrum surface 12 and rotor 9 is rotated in the rotational direction, dynamic radius r of vane 14 varies as indicated by thick line curve ORC2 in FIG. 9B. As shown in FIG. 9B, characteristic curve ORC2 of dynamic radius r of vane 14 with respect to the rotational angle of rotor 9 has the negative slope in first closed section θR1 and the negative slope in second closed section θR2 which has a reduced magnitude.

When cam ring 7 having the oval cam profile shown in FIG. 5B is swung on fulcrum surface 12 of adapter ring 5 from the maximum eccentric state to the minimum eccentric state via the medium eccentric state, dynamic radius r of vane 14 varies along with the rotation of rotor 9 as indicated by characteristic curves L, M and S in FIG. 10. Characteristic curves L, M and S denote variation in dynamic radius r of vane 14 with respect to the rotational angle of rotor 9 in the maximum eccentric state, the medium eccentric state and the minimum eccentric state of cam ring 7, respectively.

Characteristic curves L, M and S in first closed section θR1 as shown in FIG. 10 are similar to characteristic curves L, M and S in first closed section θR1 as shown in FIG. 11. Whereas, characteristic curves L, M and S in second closed section θR2 as shown in FIG. 10 respectively have a small magnitude of the positive slope, no slope and a small magnitude of the negative slope which are determined by subtracting the initial magnitude of the negative slope set for second closed section θR2 as shown in FIG. 9A from the positive slopes of characteristic curves L, M and S in second closed section θR2 as shown in FIG. 11. Such slopes of characteristic curves L, M and S in second closed section θR2 as shown in FIG. 10 are provided on the basis of the second curve of the oval cam profile shown in FIG. 5B which extends over second closed section θR2, and associated with a lift amount of cam ring 7 which is determined by subtracting the downwardly offset amount of the center of the second curve from the lift amount of cam ring 7 in the respective eccentric states. That is, since the center of the second curve is vertically downwardly offset from center Ocr of rotor 9, reduction of the lift amount of cam ring 7 having the cam profile shown in FIG. 5B in second closed section θR2 is caused as compared to the lift amount of cam ring 7 having the oval cam profile shown in FIG. 5A. As a result, in the power steering apparatus using the variable displacement pump of this embodiment, it is possible to perform smooth drop in fluid pressure and suppress separation of the leading edge of vane 14 from inner circumferential surface 7*a* of cam ring 7 in second closed section θR2 over the entire operating region of the pump.

As described above, in the variable displacement pump of this embodiment, the cam profile of cam ring 7 which is defined by inner circumferential surface 7*a* is formed into the predetermined oval shape that is substantially concentric with rotor 9 in first closed section θR1 and provides the negative slope of the characteristic curve of dynamic radius r of vane 14 with respect to the rotational direction of rotor 9 in second closed section θR2. Cam ring 7 is assembled to adapter ring 5 having fulcrum surface 12 with the reverse inclination such that cam ring 7 is placed in the above-explained eccentric lift position. Accordingly, in the power steering apparatus using the variable displacement pump of this embodiment, occurrence of pulsation, vibration and noise can be suppressed over the entire operating region of the pump by changing the port timing angle (port timing) along with the swing motion of cam ring 7.

Further, in the variable displacement pump of this embodiment, the cam profile of cam ring 7 which is defined by inner circumferential surface 7*a* includes curves different in curvature from each other, that is, the first curve extending over first closed section θR1, the second curve extending over second closed section θR2 and transition curve K3 continuously connecting the first curve and the second curve. With the configuration of the cam profile, vane 14 can be smoothly moved so as to project from and retreat into slot 13.

Specifically, the curvature of the cam profile of cam ring 7, i.e., the curvature of inner circumferential surface 7*a* of cam ring 7, varies between the first curve and the second curve. If the variation in curvature of the cam profile is large, during an operation of the pump at high rotation speed, the leading edge of vane 14 will separate from inner circumferential surface 7*a* of cam ring 7 due to slide resistance between vane 14 and rotor 9 to thereby cause deterioration in pump performance, or will impact on inner circumferential surface 7*a* to thereby generate noise. Therefore, by continuously connecting the first curve and the second curve through transition curve K3, the variation in curvature of the cam profile can be reduced to thereby ensure a smooth slide movement of vane 14 relative to slot 13 and eliminate the above problems.

Further, since cam ring 7 is swingably disposed on fulcrum surface 12 of adapter ring 5, sealing of first fluid pressure chamber 10 between cam ring 7 and adapter ring 5 and a smooth swing motion of cam ring 7 can be ensured.

Further, a distance between center Or of rotor 9 and center Oc of cam ring 7 can be controlled by adjusting a height of fulcrum surface 12 by controlling a thickness of adapter ring 5. This allows facilitated control of the lift amount of cam ring 7, and therefore, allows effectively suppressing occurrence of separation of the leading edge of vane 14 and inner circumferential surface 7*a* of cam ring 7. In addition, an existing pump body can be used without modifying a design thereof, thereby serving for facilitating a production work of the variable displacement pump and reducing a production cost thereof.

Further, in this embodiment, since fulcrum surface 12 of adapter ring 5 has the reverse inclination, the port timing angle can be changed to thereby reduce pump pulsation in both a pump operating condition at high discharge fluid pressure and low rotation speed and a pump operating condition at low discharge fluid pressure and high rotation speed.

Further, in this embodiment, with the provision of the reverse inclination on fulcrum surface 12 of adapter ring 5, cam ring 7 can be arranged offset on the side of suction port 17 so as to be located in the vertically upwardly offset state. This allows variation of the magnitude of the port timing angle in both first closed section θR1 and second closed section θR2 along with the swing motion of cam ring 7, so that a preliminary compression of the fluid pressure in pump chamber 16 can be performed until vane 14 reaches initial end 19*a* of discharge port 19 and a preliminary expansion of the fluid pressure in pump chamber 16 can be performed until vane 14 reaches initial end 17*b* of suction port 17. As a result, a characteristic of sound and vibration of the pump can be improved.

Further, since cam ring 7 is urged toward the side of first fluid pressure chamber 10 by cam ring biasing mechanism 31, it is possible to suppress an unexpected reduction in the eccentric amount of cam ring 7, namely, an unexpected swing motion of cam ring 7 toward the side of second fluid pressure chamber 11.

Specifically, the variable displacement pump of this embodiment is of a low fluid pressure type in which the low fluid pressure on the suction side is always introduced into second fluid pressure chamber 11 as explained above. Therefore, it is difficult to obtain a sufficiently large biasing force that biases cam ring 7 in a direction in which the eccentric amount of cam ring 7 is increased. In addition, since fulcrum surface 12 has the reverse inclination declined toward the side of second fluid pressure chamber 11, it is likely that cam ring 7 leans toward the side of second fluid pressure chamber 11 is facilitated.

Therefore, in this embodiment, plunger 34 of cam ring biasing mechanism 31 is provided to urge cam ring 7 so as to project and bias cam ring 7 by the spring force of coil spring 35 and the high fluid pressure discharged from discharge portion 19. Thus, cam ring 7 is biased by the sufficiently high biasing force to thereby be prevented from leaning toward the side of second fluid pressure chamber 11. As a result, an unexpected reduction in the eccentric amount of cam ring 7 can be suppressed.

Second Embodiment

Figure 12:
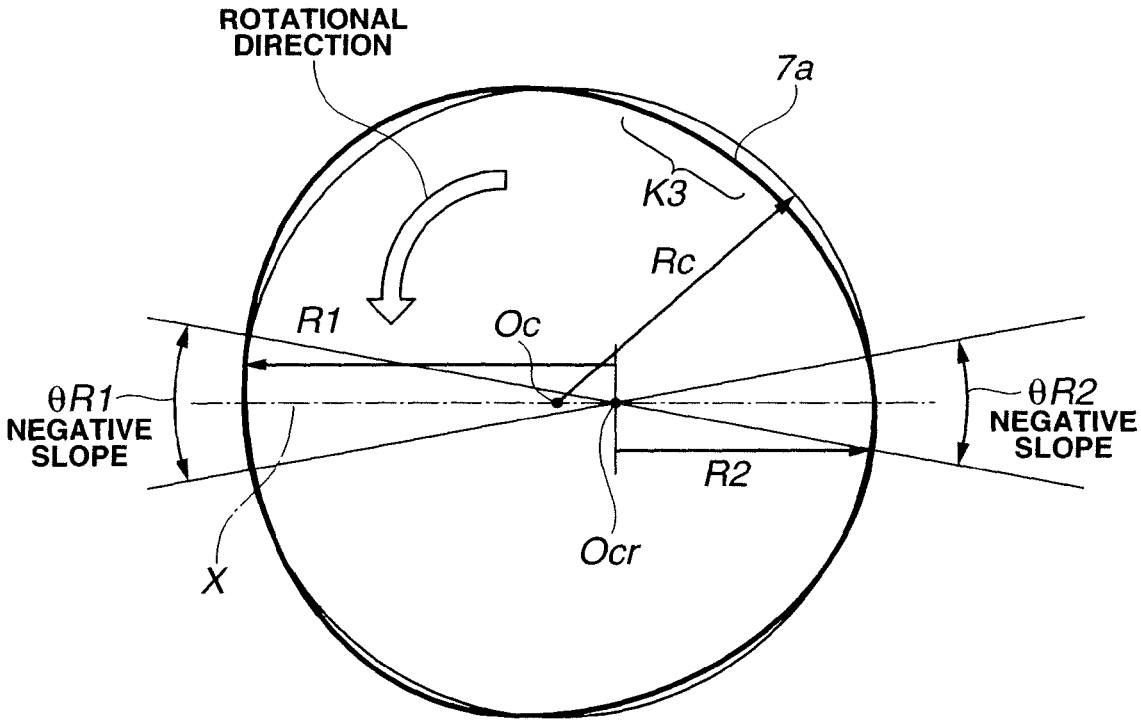
FIG. 12 is a schematic diagram illustrating a cam profile of a cam ring that is used in the variable displacement pump of a second embodiment.
Figure 13A:
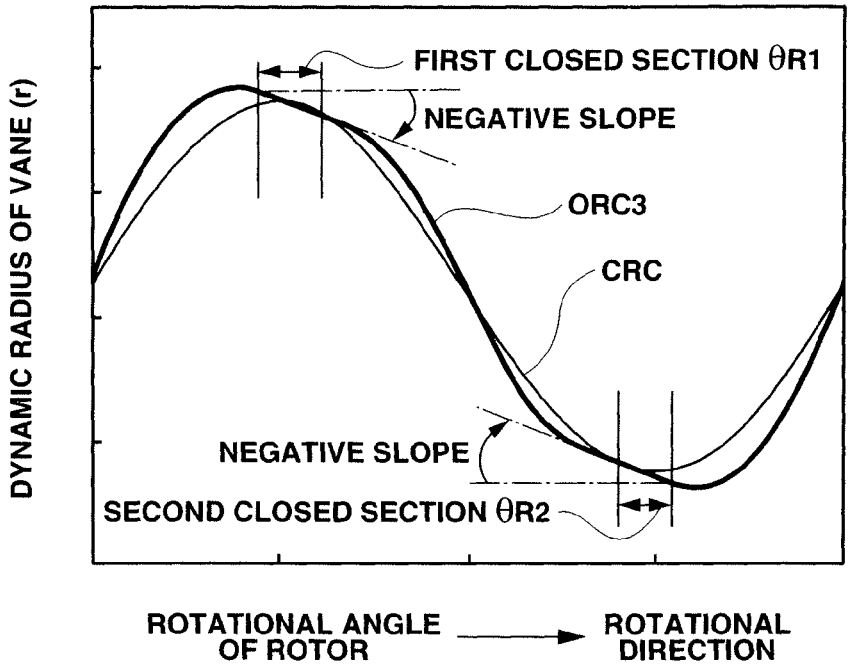
FIG. 13A is a diagram illustrating a relationship between a dynamic radius of a vane and a rotational angle of a rotor in the variable displacement pump of the second embodiment when the cam ring having the cam profile shown in FIG. 12 is placed in an eccentric no-lift state.
Figure 13B:
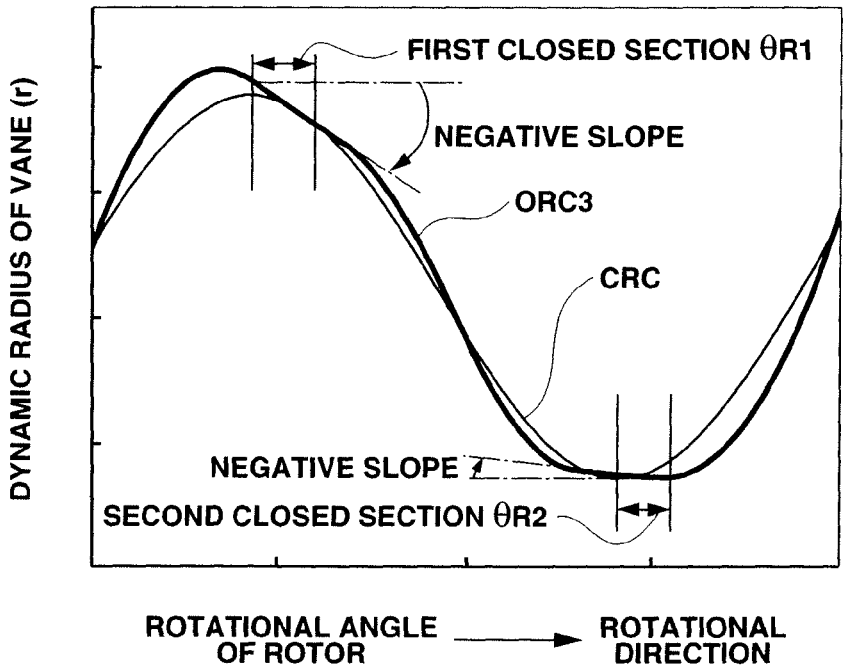
FIG. 13B is a schematic diagram illustrating a relationship between the dynamic radius of the vane and a rotational angle of the rotor in the variable displacement pump of the second embodiment when the cam ring having the cam profile shown in FIG. 12 is placed in an eccentric lift state.
Figure 14:
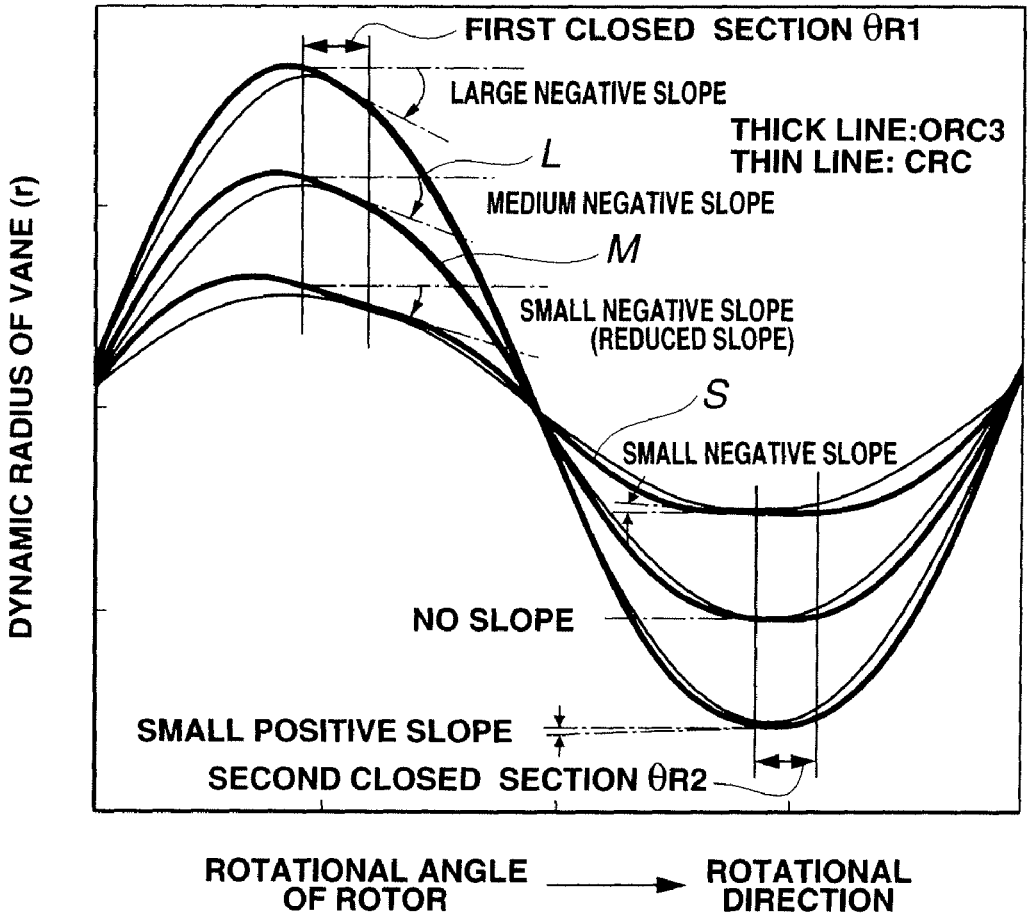
FIG. 14 is a diagram illustrating a relationship between the dynamic radius of the vane and the rotational angle of the rotor in the variable displacement pump of the second embodiment when the cam ring having the cam profile shown in FIG. 12 is controlled from the maximum eccentric state to the minimum eccentric state upon being assembled to an adapter ring having a fulcrum surface with a reverse inclination.

Referring to FIG. 12 to FIG. 14, a second embodiment of the variable displacement pump is explained, which differs from the first embodiment in the cam profile of cam ring 7. As shown in FIG. 12, the cam profile of cam ring 7 which is defined by inner circumferential surface 7*a* of cam ring 7 is formed into an oval cam profile. The oval cam profile shown in FIG. 12 provides negative slopes of characteristic curve ORC1 of dynamic radius r of vane 14 with respect to the rotational angle of rotor 9 in first closed section θR1 and second closed section θR2, respectively, as explained later. In FIG. 12, a thick line indicates the oval cam profile of cam ring 7 which has a center Oc, and a thin line indicates a complete round as a reference circle which is centered at center Oc and has radius Rc. The oval cam profile has a first curve extending over first closed section θR1, a second curve extending over second closed section θR2, and transition curve K3 that extends over non-closed sections between first closed section θR1 and second closed section θR2 and connects the first curve and the second curve with each other. Point Ocr indicates a position of the center of rotor 9 from which center Oc of the oval cam profile of cam ring 7 is horizontally offset by a predetermined eccentric amount toward the side of first closed section θR1. The first curve includes a part of a first circle that is centered at a point vertically upwardly offset from center Ocr of rotor 9, namely, offset from center Ocr of rotor 9 toward the side of suction port 17, by a predetermined amount and has radius R1. The second curve includes a part of a second circle that is centered at a point vertically downwardly offset from center Ocr of rotor 9, namely, offset from center Ocr of rotor 9 toward the side of discharge port 19, by a predetermined amount and has radius R2.

The first curve and the second curve of the oval cam profile shown in FIG. 12 are smoothly connected with each other through transition curve K3. Transition curve K3 is connected with the first circle and the second circle without change in curvature in the vicinity of transient portions which are located between first closed section θR1 and the non-closed section adjacent to first closed section θR1 and between second closed section θR2 and the non-closed section adjacent to second closed section θR2. Transition curve K3 has substantially the same radius of curvature as radius Rc of the reference circle of the complete round in the vicinity of top and bottom positions in the oval cam profile in a vertical direction extending from center Oc of cam ring 7 as shown in FIG. 12. The oval cam profile shown in FIG. 12 is configured such that the radius of curvature in first closed section θR1 and second closed section θR2 is gradually decreased in the rotational direction of rotor 9. Cam ring 7 having the oval cam profile shown in FIG. 12 is assembled to adapter ring 5 having fulcrum surface with the reverse inclination as explained in the first embodiment. The oval cam profile as shown in FIG. 12 is determined such that a characteristic curve of dynamic radius r of vane 14 with respect to the rotational angle of rotor 9 has negative slopes in respective first closed section θR1 and second closed section θR2. Other structural features of the variable displacement pump of the second embodiment are the same as those of the first embodiment.

Functions of the variable displacement pump of the second embodiment are explained.

FIG. 13A shows variation in dynamic radius r of vane 14 under the condition that cam ring 7 having the oval cam profile shown in FIG. 12 is placed in the eccentric no-lift state with no lift amount (i.e., no upwardly offset amount) at no reverse inclination angle and with a predetermined small eccentric amount toward the side of first closed section θR1 and rotor 9 is rotated. In FIG. 13A, thick line curve ORC3 indicates a characteristic curve of dynamic radius r of vane 14 with respect to the rotational angle of rotor 9 when cam ring 7 has the oval cam profile shown in FIG. 12, and thin line curve CRC indicates a characteristic curve of dynamic radius r of vane 14 with respect to the rotational angle of rotor 9 when cam ring 7 has the complete round-shaped cam profile shown in FIG. 12. As shown in FIG. 13A, characteristic curve ORC3 of dynamic radius r of vane 14 has negative slopes in first closed section θR1 and second closed section θR2, respectively. The negative slope in first closed section θR1 is determined by the first circle of the oval cam profile which has the upwardly offset center as shown in FIG. 12. The negative slope in second closed section θR2 is determined by the second circle of the oval cam profile which has the downwardly offset center as shown in FIG. 12.

FIG. 13B shows variation in dynamic radius r of vane 14 along with the rotation of rotor 9 under the condition that cam ring 7 having the oval cam profile shown in FIG. 12 is placed in the eccentric lift state with a predetermined lift amount (i.e., a predetermined upwardly offset amount) and the predetermined eccentric amount (i.e., the predetermined horizontally offset amount) toward the side of first closed section θR1. In FIG. 13B, thick line curve ORC3 indicates a characteristic curve of dynamic radius r of vane 14 with respect to the rotational angle of rotor 9 when cam ring 7 has the oval cam profile shown in FIG. 12, and thin line curve CRC indicates a characteristic curve of dynamic radius r of vane 14 with respect to the rotational angle of rotor 9 when cam ring 7 has the complete round-shaped cam profile shown in FIG. 12. As shown in FIG. 13B, characteristic curve ORC3 of dynamic radius r of vane 14 with respect to the rotational angle of rotor 9 has an increased magnitude of the negative slope in first closed section θR1 which is determined by adding an increment of the negative slope due to the predetermined upwardly offset amount of cam ring 7 to the negative slope in first closed section θR1 as shown in FIG. 13A. In contrast, characteristic curve ORC3 of dynamic radius r of vane 14 with respect to the rotational angle of rotor 9 has a decreased magnitude of the negative slope in second closed section θR2 which is determined by subtracting the predetermined upwardly offset amount of cam ring 7 from the negative slope in second closed section θR2 as shown in FIG. 13A.

FIG. 14 shows variation in dynamic radius r of vane 14 which is caused when cam ring 7 having the oval cam profile shown in FIG. 12 is swung on fulcrum surface 12 of adapter ring 5 between the maximum eccentric state, the medium eccentric state and the minimum eccentric state along with the rotation of rotor 9. In FIG. 14, three thick line curves ORC indicate characteristic curves of dynamic radius r of vane 14 with respect to the rotational angle of rotor 9 as indicated at L, M and S, respectively. Characteristic curves L, M and S are exhibited when cam ring 7 having the oval cam profile shown in FIG. 12 is placed in the maximum eccentric state, the medium eccentric state and the minimum eccentric state, respectively. Thin line curves CRC extending adjacent along thick line curves ORC3 indicate characteristic curves of dynamic radius r of vane 14 with respect to the rotational angle of rotor 9 which are exhibited when cam ring 7 having the complete round-shaped cam profile is placed in the maximum eccentric state, the medium eccentric state and the minimum eccentric state, respectively.

Characteristic curves L, M and S in first closed section θR1 as shown in FIG. 14 respectively have negative slopes that are determined by adding an increment of the negative slope due to the lift amount of cam ring 7 (the port timing angle) in the respective eccentric states to the initial negative slope of characteristic curve ORC3 in first closed section θR1 as shown in FIG. 13B (the upwardly offset amount of the center of the first circle of the cam profile shown in FIG. 12). The magnitude of the respective negative slopes in first closed section θR1 is gradually reduced in association with change in the eccentric state of cam ring 7 from the maximum eccentric state to the minimum eccentric state. Characteristic curves L, M and S in second closed section θR2 as shown in FIG. 14 are similar to characteristic curves L, M and S in second closed section θR2 as shown in FIG. 10 in the first embodiment.

In this embodiment, the negative slope in first closed section θR1 can be controlled by adjusting the initial magnitude of the negative slope in first closed section θR1 as shown in FIG. 13B or the lift amount of cam ring 7 (the port timing angle) which is based on an inclination angle of the reverse inclination. A rate of variation in the magnitude of the slope which is caused along with the swing motion of cam ring 7 can be controlled by adjusting variation in the inclination angle of the reverse inclination (variation in the port timing angle).

In the power steering apparatus using the variable displacement pump of this embodiment, the negative slope of characteristic curve L in first closed section θR1 as shown in FIG. 14 has a large magnitude when the pump discharge pressure is high upon operating the steering wheel at low vehicle speed and at low pump rotation speed (in the maximum eccentric state of cam ring 7). As a result, it is possible to prevent the leading edge of vane 14 from separating apart from inner circumferential surface 7*a* of cam ring 7 and increase the preliminary compression to thereby perform smooth rise in the fluid pressure in pump chamber 16 in first closed section θR1 toward the high discharge pressure. On the other hand, in the same operating condition, characteristic curve L in second closed section θR2 as shown in FIG. 14 has a slight magnitude of the positive slope. It is possible to suppress separation of the leading edge of vane 14 from inner circumferential surface 7*a* of cam ring 7 and perform smooth drop in fluid pressure by the preliminary expansion.

When the pump discharge pressure is low upon straight traveling of the vehicle at medium rotation speed and high rotation speed of the pump (in the medium eccentric state and the minimum eccentric state of cam ring 7), the magnitude of the respective negative slopes of characteristic curves M and S in first closed section θR1 as shown in FIG. 14 is reduced. As a result, it is possible to suppress separation of the leading edge of vane 14 from inner circumferential surface 7*a* of cam ring 7 and reduce the preliminary compression to thereby perform smooth rise of the fluid pressure in pump chamber 16 in first closed section θR1 toward the low discharge pressure.

On the other hand, in the same operating condition, characteristic curves M and S in second closed section θR2 as shown in FIG. 14 has no slope and a slight magnitude of the negative slope (namely, zero or about zero). As a result, it is possible to suppress separation of the leading edge of vane 14 from inner circumferential surface 7*a* of cam ring 7 and perform smooth transition in fluid pressure from the low discharge pressure to the suction pressure.

As explained above, in the second embodiment using the cam profile of cam ring 7 as shown in FIG. 12 and the reverse inclination for cam ring 7, the port timing angle can be variably controlled to thereby suppress pulsation in fluid pressure due to separation of vane 14 from inner circumferential surface 7*a* of cam ring 7, perform smooth rise and drop in fluid pressure and reduce vibration and noise which are caused in the pump, over the entire operating region of the variable displacement pump in the power steering apparatus.

The following are functions and effects of the variable displacement pump of the above embodiments according to the present invention.

Dynamic radius r of vane 14 which extends from center Or of rotor 9 to the leading edge of each of vanes 14 is gradually decreased in a closed section (first closed section θR1) that is defined between terminal end 17*a* of suction port 17 and initial end 19*a* of discharge port 19, along with rotation of rotor 9. A port timing that is defined as a position of terminal end 17*a* of suction port 17 or a position of initial end 19*a* of discharge port 19 with respect to a rotational position of vane 14 varies along with a swing motion of cam ring 7.

With this construction, it is possible to prevent the leading edge of vane 14 from separating from inner circumferential surface 7*a* of cam ring 7 and vary the port timing that is an opening timing of respective suction port 17 and discharge port 19 and a closing timing thereof. As a result, the port timing can be optimized regardless of the swing position of cam ring. In a case where the variable displacement pump of the embodiments is applied to a power steering apparatus, in the operating condition at low rotation speed and high discharge pressure, the port timing angle is increased to thereby provide a large magnitude of a negative slope of a characteristic curve of dynamic radius r of vane 14 with respect to a rotational angle of rotor 9. In the operating condition at high rotation speed and low discharge pressure, the port timing angle is decreased to thereby provide a small magnitude of the negative slope of the characteristic curve of dynamic radius r of vane 14 with respect to a rotational angle of rotor 9. As a result, it is possible to effectively reduce vibration and noise in the pump regardless of the swing position of cam ring 7.

The cam profile of cam ring 7 is configured such that dynamic radius r of vane 14 is gradually decreased in a closed section (first closed section θR1) along with rotation of rotor 9. With the configuration of the cam profile of cam ring 7, it is possible to suppress occurrence of separation of the leading edge of vane 14 from inner circumferential surface 7*a* of cam ring 7.

The cam profile of cam ring 7 includes a first curve that extends over the closed section, a second curve that extends over a closed section that is defined between terminal end 19*b* of discharge port 19 and initial end 17*b* of suction port 17, and transition curve K3 that connects the first curve and the second curve. Since the curvature of the one curve and the curvature of the other curve are different from each other, the one curve and the other curve are continuously connected with each other through transition curve K3 without change in curvature at the connection between the one curve and transition curve K3 and at the connection between the other curve and transition curve K3.

That is, the curvature of the cam profile of cam ring 7, i.e., the curvature of inner circumferential surface 7*a* of cam ring 7, varies between the one curve and the other curve. If the variation in curvature of the cam profile is large, during an operation of the pump at high rotation speed, the leading edge of vane 14 will separate from inner circumferential surface 7*a* of cam ring 7 and rotor 9 to thereby cause deterioration in pump performance, or will impact on inner circumferential surface 7*a* to thereby generate noise. Therefore, by continuously connecting the one curve and the other curve through transition curve K3, the variation in curvature of the cam profile can be reduced to thereby ensure a smooth slide movement of vane 14 relative to slot 13 and eliminate the above problems.

Suction port 17 and discharge port 19 are arranged such that dynamic radius r of vane 14 is gradually decreased in the closed section along with rotation of rotor 9. When the pump discharge pressure is high upon operating a steering wheel at a low vehicle speed and at a low rotation speed of the pump (in the maximum eccentric state of cam ring 7), the magnitude of the negative slope of the characteristic curve of dynamic radius r of vane 14 in the closed section becomes larger to thereby cause large preliminary compression of the fluid pressure in pump chamber 16 in the closed section. As a result, the fluid pressure in pump chamber 16 in the closed section is smoothly increased to the discharge pressure, and therefore, pulsation, vibration and noise in the pump can be improved over the entire operating region of the pump.

Cam ring 7 is arranged to be linearly moveable relative to pump body 2. With this arrangement of cam ring 7, it is possible to readily control change in position of cam ring 7 relative to suction port 17 and discharge port 19 along with the movement of cam ring 7.

Cam ring 7 is arranged to be swingably moveable relative to pump body 2. Since cam ring 7 is swingably moved on fulcrum surface 12, it is possible to perform sealing of first fluid pressure chamber 10 on fulcrum surface 12 and make a smooth swing motion of cam ring 7 by the fluid pressure in first fluid pressure chamber 10.

Dynamic radius r of vane 14 is gradually decreased in a closed section (second closed section θR2) that is defined between terminal end 19*b* of discharge port 19 and initial end 17*b* of suction port 17, along with rotation of rotor 9. With this construction, it is possible to prevent the leading edge of vane 14 from separating from inner circumferential surface 7*a* of cam ring 7 in both of the closed sections. As a result, it is possible to more effectively suppress occurrence of driving vibration and noise in the pump.

Cam ring 7 is disposed on fulcrum surface 12 so as to be swingable about a swing fulcrum, and fulcrum surface 12 is formed on pump body 2 so as to vary the position of terminal end 17*a* of suction port 17 or initial end 19*a* of discharge port 19 (namely, the port timing) with respect to the rotational position of vane 14, along with the swing motion of cam ring 7. By adjusting a height of fulcrum surface 12 of pump body 2, it is possible to control a height of cam ring 7, that is, the port timing angle that is formed between line Oc-Or that passes through center Oc of the cam profile of cam ring 7 and center Or of rotor 9, and the port timing line. Since the height of cam ring 7 varies upon changing the eccentric state of cam ring 7 along with the swing motion of cam ring 7, pulsation, vibration and noise in the pump can be suitably reduced in the entire operating region of the pump in the power steering apparatus. As a result, it is possible to sufficiently reduce an area where there occurs a clearance between the leading edge of each of vanes 14 and inner circumferential surface 7*a* of cam ring 7.

Fulcrum surface 12 is an inclined surface that is formed such that a distance from reference line X that connects the rotation center of driving shaft 8 with a midpoint between terminal end 17*a* of suction port 17 and initial end 19*a* of discharge port 19, is gradually increased from the swing fulcrum toward a side of second fluid pressure chamber 11. With the provision of fulcrum surface 12 having such a reverse inclination, the port timing angle can be changed to thereby reduce pump pulsation in both a pump operating condition at high discharge fluid pressure and low rotation speed and a pump operating condition at low discharge fluid pressure and high rotation speed.

Fulcrum surface 12 is formed to offset center Oc of the cam profile that is defined by inner circumferential surface 7*a* of cam ring 7, from rotation center Or of rotor 9 toward the side of suction port 17. With the construction of fulcrum surface 12 with the reverse inclination, cam ring 7 is located in the vertically upwardly offset state to thereby vary the magnitude of the port timing angle in the closed section along with the swing motion of cam ring 7. As a result, it is possible to prevent separation of the leading edge of vane 14 from inner circumferential surface 7*a* of cam ring 7, perform preliminary compression of the fluid pressure in pump chamber 16 in the closed section, and reduce pulsation, vibration and noise in the pump.

Further, inner circumferential surface 7*a* of cam ring 7 defines a cam profile including a part of a circle curve substantially concentric with rotor 9. The part of the circle curve extends over the closed section that is defined between terminal end 17*a* of suction port 17 and initial end 19*a* of discharge port 19. Cam ring 7 is disposed offset from rotation center Or of rotor 9 toward the side of suction port 17. With this construction, cam ring 7 is placed in a lift state, namely, an upwardly offset state offset toward the side of suction port 17, so that the negative slope of the characteristic curve of dynamic radius r of vane 14 with respect to the rotational angle of rotor 9 is set. Also, a lift amount of cam ring 7 and a magnitude of the negative slope are set on the basis of the eccentric state of cam ring 7. Further, since cam ring 7 is located in the vertically upwardly offset state, the magnitude of the port timing angle in the closed section varies along with the swing motion of cam ring 7. Dynamic radius r of vane 14 is gradually decreased in the closed section to thereby prevent the leading edge of vane 14 from separating from inner circumferential surface 7*a* of cam ring 7. As a result, it is possible to perform preliminary compression of the fluid pressure in pump chamber 16 in the closed section and reduce pulsation, vibration and noise in the pump. In a case where the variable displacement pump of the above embodiments is applied to various hydraulic apparatus, it is possible to reduce vibration and noise which will be caused by fluid pressure depending on the pump operating condition.

Inner circumferential surface 7*a* of cam ring 7 is configured to be offset with respect to rotation center Or of rotor 9 toward the side of suction port 17. Since cam ring 7 is disposed on fulcrum surface 12 in such a direction that cam ring 7 is upwardly offset, the magnitude of the port timing angle in the closed section can be varied along with the swing motion of cam ring 7. Dynamic radius r of vane 14 is gradually decreased in the closed section to thereby prevent the leading edge of vane 14 from separating from inner circumferential surface 7*a* of cam ring 7. As a result, it is possible to perform preliminary compression of the fluid pressure in pump chamber 16 in the closed section and reduce pulsation, vibration and noise in the pump.

Pump body 2 includes a body formed with suction port 17 and discharge port 19, and adapter ring 5 that is disposed within the body and cooperates with cam ring 7 to define first fluid pressure chamber 10 and second fluid pressure chamber 11 therebetween. Cam ring 7 is moveable on fulcrum surface 12 that is formed on an inner circumferential surface of adapter ring 5. Fulcrum surface 12 is formed such that inner circumferential surface 7*a* of cam ring 7 is offset from rotation center Or of rotor 9 toward the side of suction port 17. With this arrangement, fulcrum surface 12 on which cam ring 7 is swingably supported can be controlled by adjusting a shape of the inner circumferential surface of adapter ring 5. An existing pump body can be used without modifying a design thereof, thereby serving for facilitating a production work of the variable displacement pump and reducing a production cost thereof.

Cam ring 7 has a generally annular shape and an inner circumference of cam ring 7 is offset relative to an outer circumference of cam ring 7 toward the side of suction port 17. With this arrangement, dynamic radius r of vane 14 can be controlled by adjusting only the shape of cam ring 7. This serves for facilitating the production work and thereby enhancing the cost saving.

This application is based on a prior Japanese Patent Application No. 2007-301142 filed on Nov. 21, 2007. The entire contents of the Japanese Patent Application No. 2007-301142 are hereby incorporated by reference.

Although the invention has been described above by reference to certain embodiments of the invention and modifications of the embodiments, the invention is not limited to the embodiments and modifications described above. Further modifications and variations of the embodiments and modifications described above will occur to those skilled in the art in light of the above teachings. The scope of the invention is defined with reference to the following claims.

What is claimed is:

1. A variable displacement pump, comprising:

a pump body;

a driving shaft rotatably supported in the pump body;

a rotor within the pump body and rotatably driven by the driving shaft, the rotor having a plurality of slots on an outer circumferential portion of the rotor;

a plurality of vanes, each of vanes fitted into a separate one of the slots so as to project from the separate one of the slots and retreat into the separate one of the slots in a radial direction of the rotor, the plurality of vanes being rotatable together with the rotor in a rotational direction of the rotor;

a cam ring within the pump body so as to be swingable about a swing fulcrum on a fulcrum surface formed on an inner surface of the pump body, the cam ring cooperating with the rotor and the vanes to define a plurality of pump chambers on an inner circumferential side of the cam ring;

a first member and a second member each on opposite sides of the cam ring in an axial direction of the cam ring;

a suction port and a discharge port on a side of at least one of the first and second members, the suction port being opened to a suction region in which volumes of the plurality of pump chambers are increased along with rotation of the rotor, the discharge port being opened to a discharge region in which the volumes of the plurality of pump chambers are decreased along with rotation of the rotor; and a first fluid pressure chamber and a second fluid pressure chamber on an outer circumferential side of the cam ring in an opposed relation to each other in a radial direction of the cam ring, the first fluid pressure chamber in one direction in which the cam ring is swingable to increase a discharge amount of a working fluid, the second fluid pressure chamber in the other direction in which the cam ring is swingable to reduce the discharge amount of the working fluid, wherein the fulcrum surface on which the cam ring is supported is formed such that a distance from a reference line that connects a rotation center of the driving shaft with a midpoint between a terminal end of the suction port and an initial end of the discharge port is gradually increased from the swing fulcrum toward a side of the second fluid pressure chamber, even when the cam ring is located in any swing position, a dynamic radius of one the vanes which extends from a center of the rotor to a leading edge of each of the vanes is always gradually decreased in a first closed section that is defined between the terminal end of the suction port and the initial end of the discharge port, along with rotation of the rotor, a port timing angle between at least a port timing line extending between the center of the rotor and a point that is located offset from the terminal end of the suction port in the rotational direction of the pump by an angle of a half of a vane pitch, and a line extending between a center of the cam ring and the center of the rotor, when an eccentric amount of the cam ring is large, the port timing angle is increased such that a characteristic curve of the dynamic radius of the vane in the first closed section has a large negative slope, and when the eccentric amount of the cam ring is small, the port timing angle is reduced to be smaller than the port timing angle increased when the eccentric amount of the cam ring is large, such that the characteristic curve of the dynamic radius of the vane in the first closed section has a small negative slope, an inner circumferential surface of the cam ring defines a cam profile having a first radius of curvature in the first closed section, the first radius of curvature is a distance from the center of the rotor to a portion of the inner circumferential surface of the cam ring which extends over the first closed section when the cam ring is placed in a maximum eccentric state, the cam profile defined by the inner circumferential surface of the cam ring has a second radius of curvature in a second closed section defined between a terminal end of the discharge port and an initial end of the suction port, the second radius of curvature being a distance from the center of the rotor to a portion of the inner circumferential surface of the cam ring which extends over the second closed section when the cam ring is placed in the maximum eccentric state, and a center of a circle having the first radius of curvature is offset from a rotation center of the rotor toward a side of the suction port.

2. The variable displacement pump as claimed in claim 1, wherein the cam profile of the cam ring comprises a first curve that extends over the first closed section, a second curve that extends over the second closed section, and a transition curve that connects the first curve and the second curve.

3. The variable displacement pump as claimed in claim 1, wherein the suction port and the discharge port are arranged such that the dynamic radius of the vane is gradually decreased in the first closed section along with rotation of the rotor.

4. The variable displacement pump as claimed in claim 3, wherein the cam ring is arranged to be linearly moveable relative to the pump body.

5. The variable displacement pump as claimed in claim 3, wherein the cam ring is arranged to be swingably moveable relative to the pump body.

6. The variable displacement pump as claimed in claim 3, wherein the dynamic radius of the vane is gradually decreased in the second closed section along with rotation of the rotor.

7. The variable displacement pump as claimed in claim 1, wherein the fulcrum surface offsets a center of the cam profile from a rotation center of the rotor toward a side of the suction port.

* * * * *